US011649555B2

(12) United States Patent
Kim et al.

(10) Patent No.: US 11,649,555 B2
(45) Date of Patent: May 16, 2023

(54) ELECTROPLATING APPARATUS AND ELECTROPLATING METHOD USING THE SAME

(71) Applicant: LG Display Co., Ltd., Seoul (KR)

(72) Inventors: Gotae Kim, Seoul (KR); WooChan Kim, Goyang-si (KR); Changjun Choi, Paju-si (KR); SangCheol Moon, Paju-si (KR); Wook Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 146 days.

(21) Appl. No.: 16/573,905

(22) Filed: Sep. 17, 2019

(65) Prior Publication Data

US 2020/0208290 A1 Jul. 2, 2020

(30) Foreign Application Priority Data

Dec. 31, 2018 (KR) ..... 10-2018-0173557

(51) Int. Cl.
*C25D 5/04* (2006.01)
*C25D 17/02* (2006.01)

(52) U.S. Cl.
CPC ..... *C25D 5/04* (2013.01); *C25D 17/02* (2013.01)

(58) Field of Classification Search
None
See application file for complete search history.

(56) References Cited

U.S. PATENT DOCUMENTS

2004/0000489 A1 1/2004 Zhang et al.
2004/0245093 A1* 12/2004 Hubel ..... C25D 21/12 204/198
2008/0271992 A1* 11/2008 Dordi ..... C25D 17/001 204/224 R
2010/0122908 A1* 5/2010 Takeguchi ..... C25D 5/18 205/83
2017/0145584 A1* 5/2017 Wirth ..... C25D 3/12
2017/0298529 A1 10/2017 Cheng et al.

FOREIGN PATENT DOCUMENTS

KR 10-2003-0025523 A 3/2003
KR 10-2017-0037066 A 4/2017
KR 101788678 B1 * 10/2017
KR 10-2018-0000133 A 1/2018
KR 20180000133 A * 1/2018
WO WO-2019190115 A1 * 10/2019 ..... C25D 17/00

* cited by examiner

*Primary Examiner* — Louis J Rufo
(74) *Attorney, Agent, or Firm* — Seed IP Law Group LLP

(57) ABSTRACT

An electroplating apparatus includes a plating bath and a substrate in a horizontal direction. The electroplating apparatus further includes a plurality of cathodes on first and second sides of the substrate in a first direction on one surface of the substrate, and an anode above the substrate, the anode being spaced apart from the substrate and configured to be movable in the first direction.

14 Claims, 14 Drawing Sheets

ELECTROPLATING APPARATUS AND ELECTROPLATING METHOD USING THE SAME

CROSS-REFERENCE TO RELATED APPLICATION(S)

This application claims the benefit and priority to Korean Patent Application No. 10-2018-0173557, filed on Dec. 31, 2018, the entirety of which is hereby incorporated by reference.

BACKGROUND

Technical Field

The present disclosure relates to an electroplating apparatus and an electroplating method using the same.

Discussion of the Related Art

Plating is used to increase the added-value of a final product by giving the surfaces of materials and parts functional properties such as corrosion resistance, durability, and conductivity or improving the appearance through physical, chemical, and electrochemical treatments. Thus, it has been widely used in the materials and parts industry. The plating may be classified into wet plating that is performed in an aqueous solution and dry plating that is performed in the atmosphere and a vacuum. Examples of the wet plating include electroplating, electroless plating, anodization, and chemical conversion treatment, and examples of the dry plating include hot dipping, thermal spraying, physical deposition, and chemical deposition. The wet plating has advantages such high plating speed, high economic feasibility, easiness of adding various functional properties, and convenience for continuous process and mass production.

SUMMARY

The inventors of the present disclosure used such a plating process and developed a process for forming a mask, e.g., a fine metal mask (FMM), used when manufacturing an organic light emitting display apparatus.

An organic layer of the organic light emitting display apparatus may have a patterned emission layer structure according to a design. In the organic light emitting display apparatus having the patterned emission layer structure, emission layers emitting light of different colors are separated for respective pixels.

For example, a red organic emission layer for emitting red light, a green organic emission layer for emitting green light, and a blue organic emission layer for emitting blue light may be separated in a red sub-pixel, a green sub-pixel, and a blue sub-pixel, respectively. The organic emission layers may be deposited and patterned on emission regions of the respective sub-pixels using a mask, e.g., FMM, having openings for the respective sub-pixels.

Such a mask has been typically manufactured by forming a pattern through exposure and development and then transferring the pattern on a metal sheet through wet-etching. However, when the mask is manufactured using the wet-etching process, it is difficult to precisely control the pattern width during the etching process due to the isotropy of etching. Therefore, it is difficult to obtain a high-resolution pattern.

Accordingly, the inventors of the present disclosure invented a method for manufacturing a mask using a wet-plating process instead of the above-described etching process.

As a wet-plating process, a vertical plating method in which plating is performed in a state where a substrate is disposed vertically in a plating bath has been widely used. According to the vertical plating method, a substrate is disposed vertically on the bottom of a plating bath in the plating bath. That is, when the plating bath is filled with a plating solution, plating is performed in a state where the surface of the plating solution is disposed vertically to the substrate. When plating is performed by the vertical plating method, a cathode is connected to one side of a seed pattern on the substrate and an anode is disposed on the plating solution.

The inventors of the present disclosure found that various problems may occur when using the vertical plating method. For example, according to the vertical plating method, because the cathode is connected to the seed pattern on only one side of the substrate, the cathode and the seed pattern are in contact at a single point. Thus, a resistance of the seed pattern increases away from a contact portion between the cathode and the seed pattern. Therefore, according to the vertical plating method, it is very difficult to form a uniform plating layer on the entire substrate. Further, according to the vertical plating method, the substrate is disposed in a vertical direction. Thus, a gas such as hydrogen and a by-product such as salt generated during the plating process may be accumulated in the vertical direction. For example, obstacles to plating may be accumulated. Furthermore, according to the vertical plating method, the substrate being transferred in a horizontal direction is rotated to the vertical direction in order to load the substrate into the plating bath. After the plated substrate is unloaded from the plating bath, the substrate is rotated again to the horizontal direction. Therefore, the plating bath and its peripheral devices may become bulky.

Accordingly, the inventors of the present disclosure recognized the above-described problems of the vertical plating method. Then, the inventors of the present disclosure invented an electroplating apparatus that performs plating using a horizontal plating method and a method for manufacturing the electroplating apparatus. That is, the present disclosure provides, among others, an electroplating apparatus that forms a uniform plating layer by a horizontal plating method and an electroplating method using the same.

An aspect of the present disclosure is to provide an electroplating apparatus that performs plating using a horizontal plating method to maintain a constant resistance of a seed pattern on a substrate and a method for manufacturing the electroplating apparatus.

Another aspect of the present disclosure is to provide an electroplating apparatus that performs plating using a horizontal plating method to reduce or minimize the accumulation of obstacles such as a gas or by-product generated during the plating process and a method for manufacturing the electroplating apparatus.

Another aspect of the present disclosure is to provide an electroplating apparatus that performs plating using a horizontal plating method to implement a reduced or minimized volume of a plating system for performing the plating and a method for manufacturing the electroplating apparatus.

Another aspect of the present disclosure is to provide an electroplating apparatus that can apply different current densities to respective plating regions by dividing a cathode connected to a seed pattern on a substrate into a plurality of parts and a method for manufacturing the electroplating apparatus.

Another aspect the present disclosure is to provide an electroplating apparatus that may improve the uniformity in plating thickness by reducing or minimizing the deviation in plating depending on the area of plating and a method for manufacturing the electroplating apparatus.

Another aspect of the present disclosure is to provide an electroplating apparatus that can regulate a current density for each plating region using an anode including a plurality of sub-anodes and a method for manufacturing the electroplating apparatus.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, an electroplating apparatus includes a plating bath and a substrate in a horizontal direction. The electroplating apparatus further includes a plurality of cathodes on first and second sides of the substrate in a first direction on one surface of the substrate, and an anode above the substrate, the anode being spaced apart from the substrate and configured to be movable in the first direction.

In another aspect, a horizontal electroplating apparatus includes a plating bath having a space configured to be filled with a plating solution. The horizontal electroplating apparatus further includes a plurality of first cathodes and a plurality of second cathodes disposed to face each other in the plating bath and configured to apply different current densities to respective plating regions. The horizontal electroplating apparatus also includes an anode overlying the plurality of first cathodes and the plurality of second cathodes, the anode being configured to be movable between the plurality of first cathodes and the plurality of second cathodes.

In another aspect, an electroplating method includes placing a substrate including a seed pattern in a horizontal direction in a plating bath. The electroplating method further includes placing a plurality of cathodes on first and second sides of the substrate in a first direction on one surface of the substrate, and placing an anode above the substrate, the anode being spaced apart from the substrate. The electroplating method also includes applying a current to the plurality of cathodes and the anode and forming a plating layer on the substrate based on a movement of the anode in a first direction.

In another aspect, a horizontal electroplating apparatus includes a plating bath configured to hold a plating solution and configured to hold a substrate including a plurality of plating regions, a plurality of first cathodes and a plurality of second cathodes disposed on opposing sides of the plating bath and configured to apply different current densities to respective ones of the plurality of plating regions, and an anode overlying the plurality of first cathodes and the plurality of second cathodes, the anode configured to move between the plurality of first cathodes and the plurality of second cathodes.

According to the present disclosure, it is possible to solve the problems of a vertical plating method, such as the non-uniformity in resistance of a seed pattern, the production of by-products, and a large volume of a manufacturing apparatus, which are part of the plating method.

According to the present disclosure, a plurality of cathodes is disposed on first and second sides of a substrate and a voltage applied to cathodes located corresponding to each other may be regulated or adjusted. Thus, the current density applied to each plating region may be regulated freely.

According to the present disclosure, it is possible to form a plating layer with a uniform thickness and thus improve the uniformity in plating thickness regardless of the area of plating.

According to the present disclosure, an anode is divided into a plurality of parts and a voltage is selectively applied to the plurality of divided anodes. Thus, it is possible to adjust a current density differently for regions under the respective anodes.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

Figure 1:
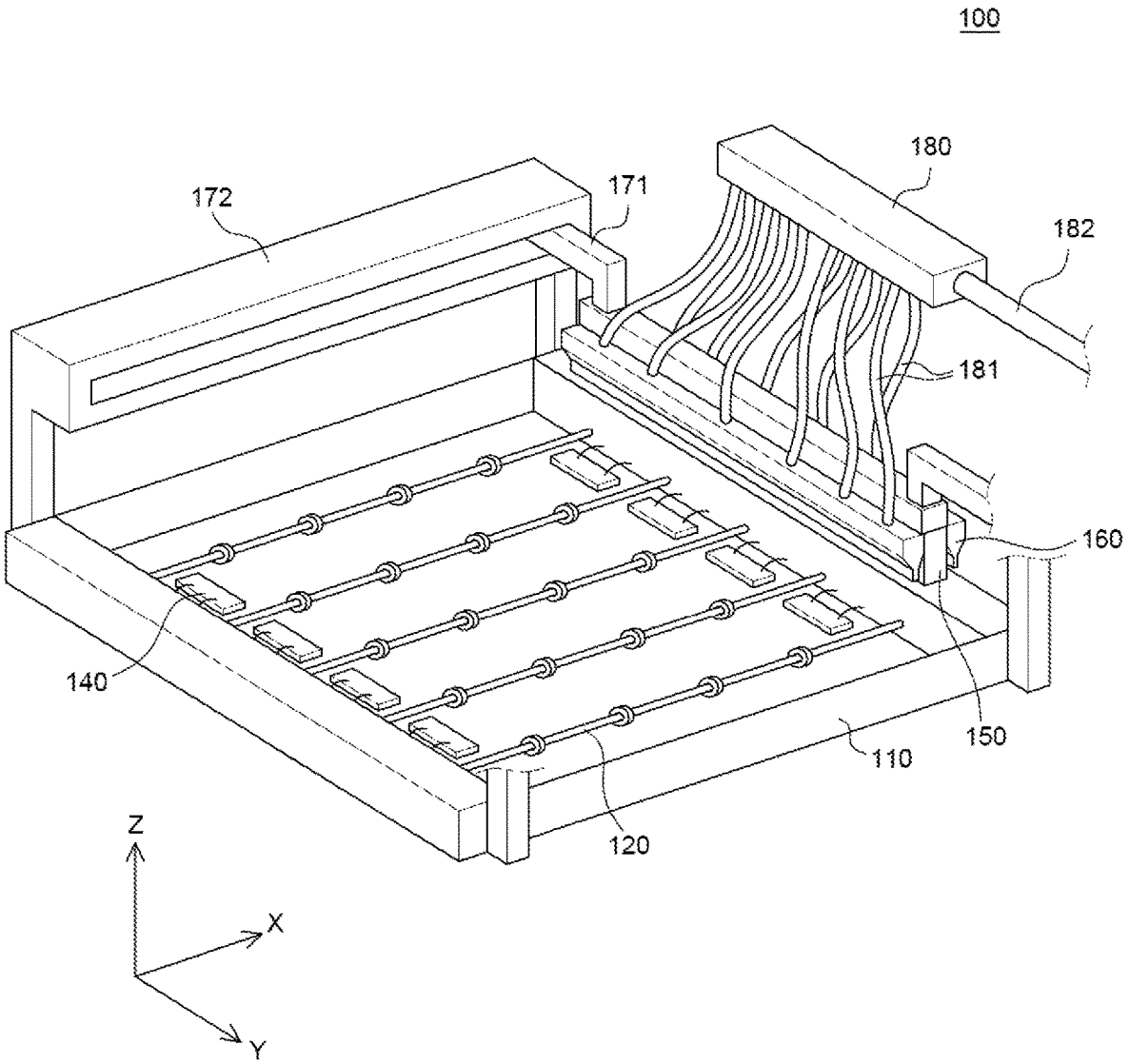
FIG. 1 illustrates an electroplating apparatus according to an embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products. Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

A shape, a size, a ratio, an angle, and a number disclosed in the drawings for describing embodiments of the present disclosure are merely an example. Thus, the present disclosure is not limited to the illustrated details. Unless otherwise described, like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," or "next," one or more other parts may be disposed between the two parts unless a more limiting term, such as "just" or "direct(ly)," is used.

In describing a time relationship, when the temporal order is described as, for example, "after," "subsequent," "next," or "before," a case which is not continuous may be included unless a more limiting term, such as "just," "immediate(ly)," or "direct(ly)," is used.

In describing elements of the present disclosure, the terms like "first," "second," "A," "B," "(a)," and "(b)" may be used. These terms are merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers "disposed" between the elements or layers, unless otherwise specified.

The term "at least one" should be understood as including any and all combinations of one or more of the associated listed items. For example, the meaning of "at least one of a first item, a second item, and a third item" encompasses the combination of all items proposed from two or more of the first item, the second item, and the third item as well as the first item, the second item, or the third item.

It will be understood that, although the terms "first," "second," etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and embodiments of the present disclosure are not limited thereto.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

Hereinafter, an electroplating apparatus and electroplating method according to an embodiment of the present disclosure will be described in detail with reference to accompanying drawings. In adding reference numerals to elements of each of the drawings, although the same elements are illustrated in other drawings, like reference numerals may refer to like elements.

Electroplating Apparatus

Figure 2:
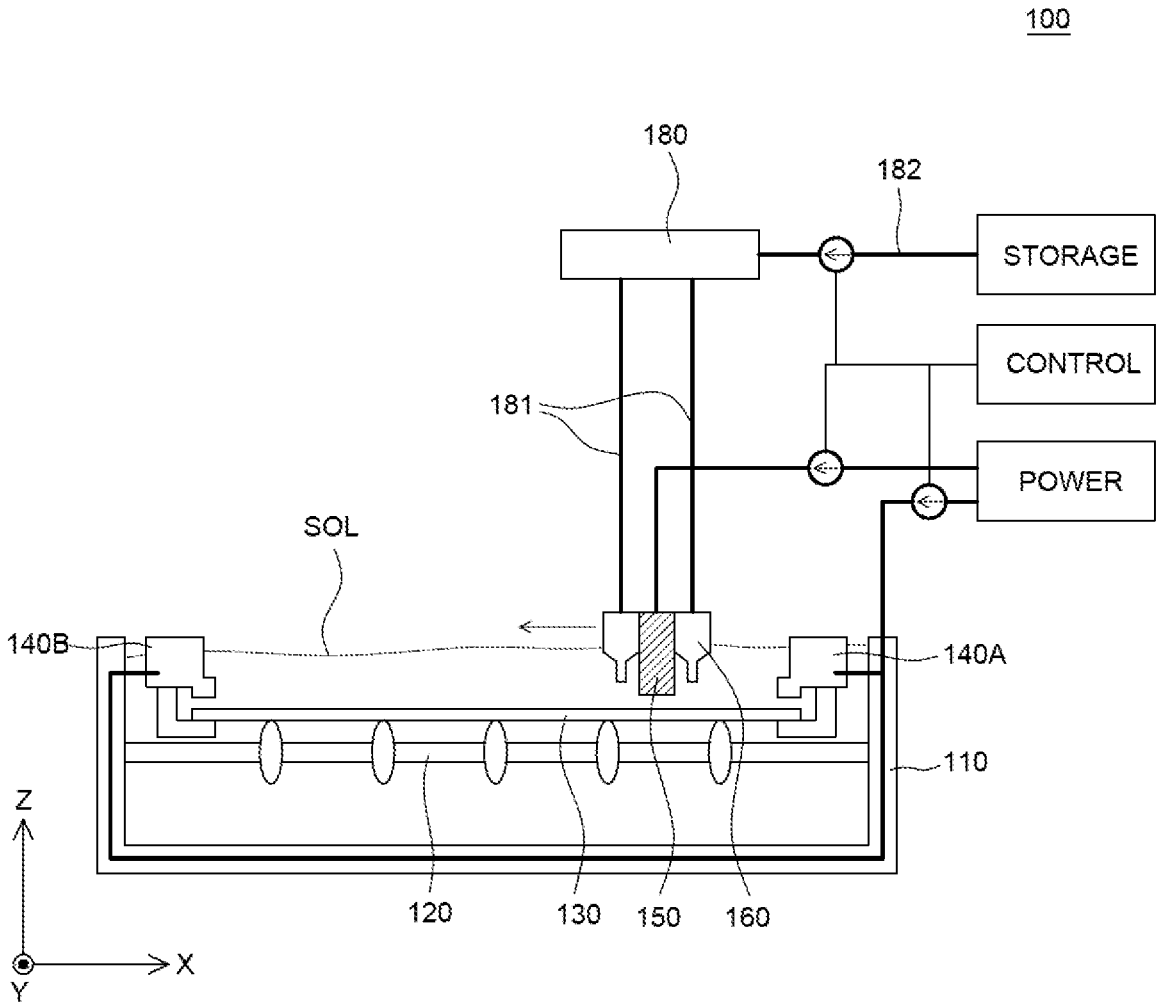
FIG. 2 is a cross-sectional view as taken along an X-Z plane of FIG. 1.
Figure 3:
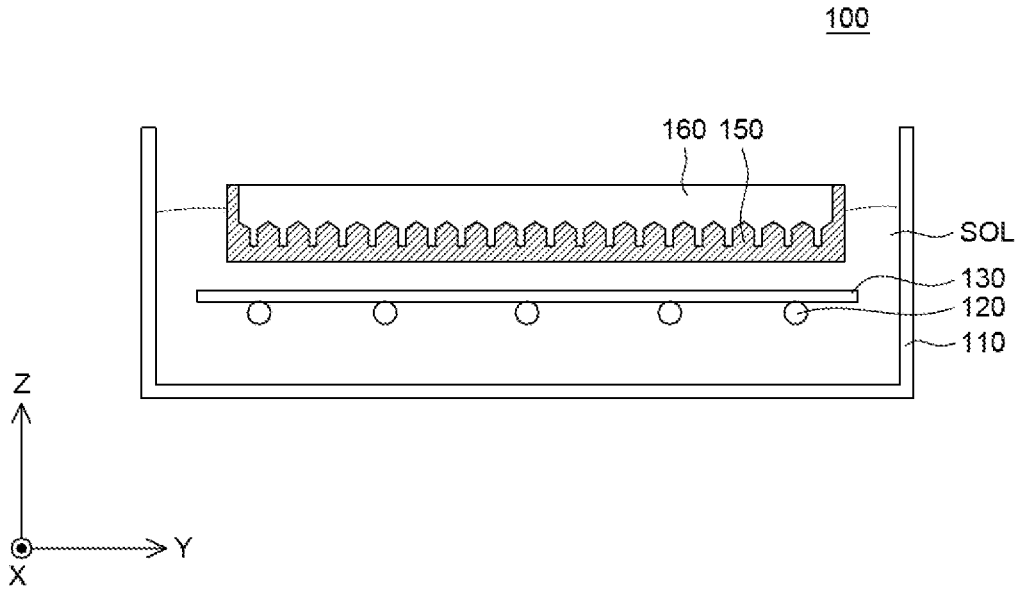
FIG. 3 is a cross-sectional view as taken along a Y-Z plane of FIG. 1.
Figure 4:
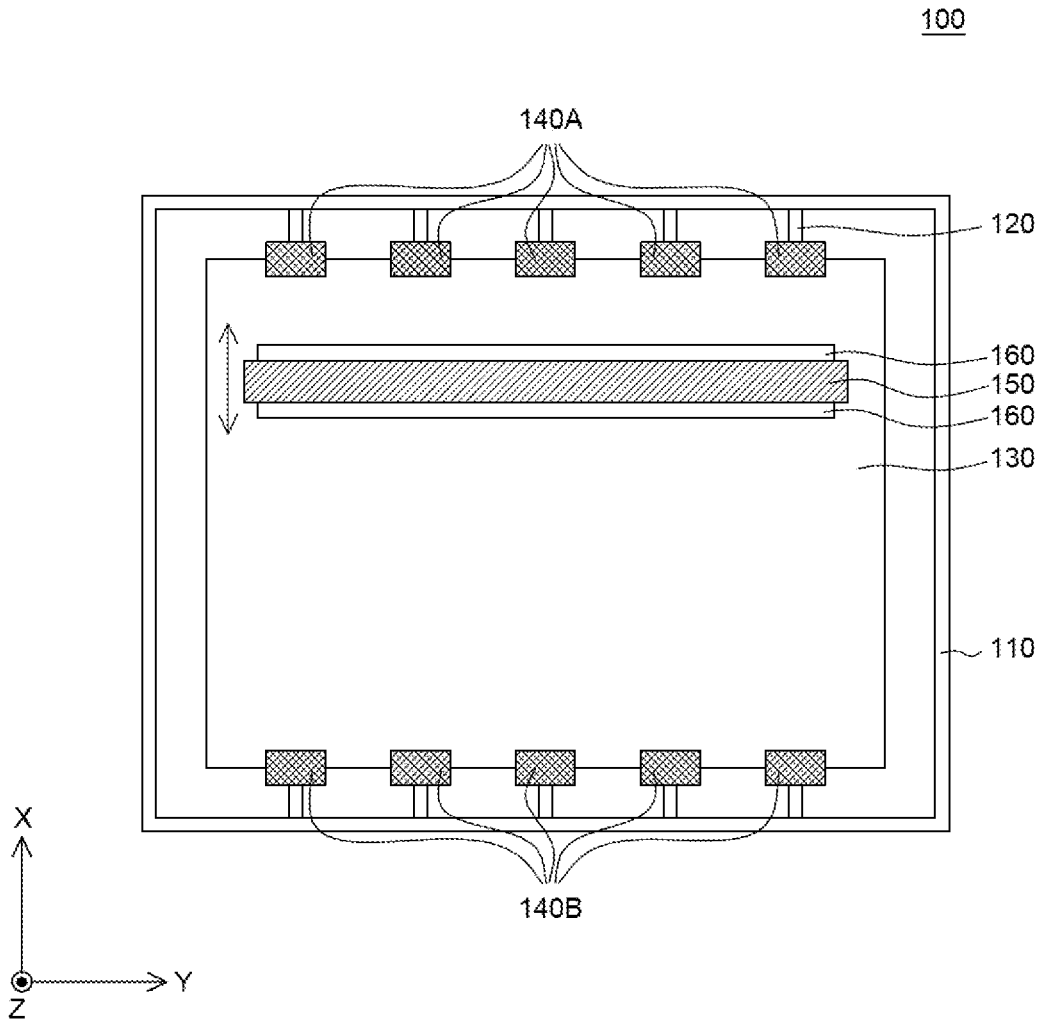
FIG. 4 is a plan view of the electroplating apparatus according to an embodiment of the present disclosure.

FIG. 1 is a perspective view of an electroplating apparatus according to an embodiment of the present disclosure. FIG. 2 is a cross-sectional view as taken along an X-Z plane of FIG. 1. FIG. 3 is a cross-sectional view as taken along a Y-Z plane of FIG. 1. FIG. 4 is a plan view of the electroplating apparatus according to an embodiment of the present disclosure.

With reference to FIG. 1 through FIG. 4, an electroplating apparatus 100 according to an embodiment of the present disclosure includes a plating bath 110, a stage 120, a substrate 130, a cathode 140, an anode 150, and a spray nozzle 160. The electroplating apparatus 100 further includes a connection unit 171, a driver 172, a plating solution transfer unit 180, a plating solution SOL, a plating solution storage unit STORAGE, a power supply unit POWER, and a controller CONTROL.

The plating bath 110 provides an inside space where a plating solution SOL is filled. In the plating bath 110, the substrate 130 on which a plating layer is to be formed is accommodated. Further, the plating bath 110 may have a spatial size where a sufficient amount of the plating solution SOL may be supplied to form a plating layer on the substrate 130 and a remaining plating solution may be discharged. The plating bath 110 may have a hexahedral shape with an opening toward an upper portion of the plating bath 110, but is not limited thereto.

The stage 120 is a substrate configured to load the substrate 130, which is a plating target object, into the plating bath 110 and support the substrate 130 during a process of supplying the plating solution SOL. The stage 120 may be disposed in the plating bath 110 to maintain a consistent horizontality. For example, the stage 120 may be disposed in a horizontal direction (X-axis/Y-axis direction). Further, the stage 120 may be disposed such that a surface of the substrate 130 disposed on the stage 120 is parallel to a surface of the plating solution SOL. FIG. 2 and FIG. 3 illustrate that the surface of the plating solution SOL is fluid to express that the plating solution SOL is liquid, but the surface of the plating solution SOL may be substantially parallel to the bottom surface of the plating bath 110.

The stage 120 may have a plurality of rod-shaped stages 120 spaced apart from each other in a specific direction as shown in FIG. 1. For example, the stage 120 includes a plurality of rods extended in the X-axis direction, and the plurality of rods may be disposed parallel in the Y-axis direction. However, the present disclosure is not limited thereto. For example, the stage 120 may be formed into a mesh shape or a plate shape.

Further, the stage 120 may include rollers mounted on a plurality of shafts and films to transfer the substrate 130. When the plurality of shafts is rotated to transfer the substrate 130, the rollers are rotated accordingly. As the rollers are rotated, the stage 120 supports and transfers the substrate 130 disposed outside the plating bath 110 into the plating bath 110. When the substrate 130 reaches a position for plating, the shafts stop driving and the stage 120 functions to support the substrate 130. FIG. 1 illustrates the stage 120 in which four rollers are mounted on each of five shafts. However, the present disclosure is not limited thereto. More stages 120 may be disposed to improve the flatness of the substrate 130.

The substrate 130 is a plating target object, and a plating layer is formed on the surface of the substrate 130 by the electroplating apparatus 100 according to an embodiment of the present disclosure. For example, a seed pattern functioning as a seed during a plating process is formed of a conductive material on the substrate 130. The substrate 130 including the seed pattern thereon is disposed on the stage 120. The substrate 130 is disposed in a horizontal direction in the plating bath 110. Thus, when the plating bath 110 is filled with the plating solution SOL, the surface of the substrate 130 may be disposed substantially parallel to the surface of the plating solution SOL. The substrate 130 may a conductor or a nonconductor, but is not limited thereto. Herein, it has been described that the substrate 130 and the seed pattern are separate components, but the substrate 130 may be defined as including the seed pattern.

The cathode 140 is disposed on first and second sides of the substrate 130 to apply a current to the substrate 130. For example, the cathode 140 may apply a current to the seed pattern on the substrate 130. Thus, a plating layer may be formed on the surface of the substrate 130 by the flow of electricity between the cathode 140 and the anode 150. The cathode 140 may be disposed in the plating bath 110 and may be in contact with first and second sides of the substrate 130. Further, the cathode 140 on the first and second sides of the substrate 130 may also fix the substrate 130 so as not to move. For example, the cathode 140 may also be configured as a clamp to grasp the first and second sides of the substrate 130, but is not limited thereto. If the substrate 130 may be fully fixed by the cathode 140, the stage 120 may not be provided.

The cathode 140 may be formed as a plurality of cathodes 140, and the plurality of cathodes 140 may be disposed corresponding to each other on the first and second sides of the substrate 130. For example, the cathode 140 may include a plurality of first cathodes 140A and a plurality of second cathodes 140B disposed on the respective first and second sides of the substrate 130 based on the X-axis direction that is a movement direction of the anode 150. The plurality of first cathodes 140A is disposed on one side of the substrate 130 based on the X-axis direction. The plurality of second cathodes 140B is disposed on the other side of the substrate 130 based on the X-axis direction. Herein, the plurality of first cathodes 140A on one side of the substrate 130 may be disposed respectively facing and corresponding to the plurality of second cathodes 140B disposed on the other side of the substrate 130. Therefore, the plurality of first cathodes 140A and the plurality of second cathodes 140B may be configured to apply different current densities to respective plating regions of the substrate 130.

The plurality of first cathodes 140A and the plurality of second cathodes 140B may be disposed parallel to the surface of the plating solution SOL in the plating bath 110. For example, a virtual plane on which the plurality of first cathodes 140A and the plurality of second cathodes 140B are disposed may be parallel to the surface of the plating solution SOL. Thus, the surface of the substrate 130 may be maintained parallel to the surface of the plating solution SOL by the plurality of cathodes 140 that fixes the substrate 130.

The anode 150 is on an upper portion of the substrate, and spaced apart from the substrate 130, and applies a current to the substrate 130. The anode 150 may be configured to move in the X-axis direction by the connection unit 171 and the driver 172. For example, the anode 150 may be configured to move between the plurality of first cathodes 140A and the plurality of second cathodes 140B. A plating layer is formed on an upper surface of the substrate 130 corresponding to a region where the anode 150 is located along the movement direction of the anode 150 by a current flowing between the anode 150 and the cathode 140. The anode 150 may be smaller in size than the substrate 130 which is a plating target object. In the horizontal electroplating apparatus, a plating layer may be formed on the substrate 130 while repeatedly moving the anode 150 one or more times in the X-axis direction.

The anode 150 may have a rectangular parallelepiped shape. For example, the anode 150 may have a rectangular shape whose width along the X-axis direction as the movement direction of the anode 150 is smaller than a length along the Y-axis direction perpendicular to the X-axis direction. Further, the anode 150 may have a rectangular shape whose width along the X-axis direction as the movement direction of the anode 150 is smaller than a height along a Z-axis direction perpendicular to the X-axis and Y-axis directions. For example, the anode 150 may have a rectangular shape whose X-axis directional width is smaller than the Y-axis directional length and the Z-axis directional height, but is not limited thereto.

The spray nozzle 160 sprays the plating solution SOL downwards toward the substrate 130. The spray nozzle 160 may be disposed adjacent to the anode 150. The spray nozzle 160 may be combined with the anode 150 and moved with the anode 150 in the X-axis direction. The spray nozzle 160 supplies the plating solution SOL from above the substrate 130. Thus, the spray nozzle 160 can support the circulation of the plating solution SOL in the plating bath 110 and maintain a constant concentration of the plating solution SOL.

The spray nozzle 160 may include a plurality of spray nozzles disposed in the Y-axis direction along the surface of the substrate 130. Because the plurality of spray nozzles 160 is used, the plating solution SOL can be rapidly supplied when electroplating is performed. Further, the spray nozzle 160 may be disposed on only one surface or on both surfaces of the substrate 130 based on the X-axis direction that is the movement direction of the anode 150. Further, the spray nozzle 160 may be rotatable with adjustable spraying direction and angle.

The connection unit 171 is disposed on the plating bath 110 and connected to the anode 150 and the spray nozzle 160. The connection unit 171 may fix the anode 150 and the spray nozzle 160 and adjust the Z-axis directional height of the anode 150 and the spray nozzle 160. The connection unit 171 may be moved by the driver 172 in the X-axis direction. The connection unit 171 may adjust the height of the spray nozzle 160 relative to the substrate 130 during a plating process to optimize a flow rate of the plating solution SOL and currents for respective regions of the substrate 130.

The driver 172 is combined with the connection unit 171 to translationally move the connection unit 171 in the X-axis direction that is the movement direction of the anode 150. The driver 172 may be disposed on an edge or a corner of the plating bath 110. The driver 172 may move the connection unit 171 and also control the movement speed of the connection unit 171. Therefore, the driver 172 controls the movement speed of the anode 150 and the spray nozzle 160 to regulate or adjust the thickness and area of a plating layer to be formed on the substrate 130.

The plating solution SOL may fill in the plating bath 110. The plating solution SOL may have various ions to be used for a plating process. A mask which is a product manufactured by using the electroplating apparatus and the electroplating method according to an embodiment of the present disclosure may be used to deposit an organic layer in a heated environment instead of at room temperature. Therefore, the mask may be formed of, e.g., Invar or the like, but is not limited thereto. If the electroplating apparatus uses Invar for plating, the plating solution SOL may be a mixture solution. The mixture solution may be composed of anhydrous nickel sulfate ($NiSO_4$), nickel ions using nickel chloride ($NiCl_2$) or the like, an iron ion source using anhydrous iron sulfate ($FeSO_4$) or the like, a pH regulator such as boric acid, polish, a stress reliever, and a stabilizer. However, the present disclosure is not limited thereto. Herein, it is assumed that the plating layer is formed of Invar, but a material of the plating layer is not limited thereto.

The plating solution storage STORAGE is a storage configured to store the plating solution SOL in the electroplating apparatus 100. The plating solution SOL in the plating solution storage STORAGE is sprayed toward the substrate 130 through a second plating solution transfer line 182, the plating solution transfer unit 180, a first plating solution transfer line 181, and the spray nozzle 160. The plating solution SOL starting from the plating solution storage STORAGE is supplied as branched in the plating solution transfer unit 180 into the plurality of spray nozzles 160 disposed in the Y-axis direction on the side of the anode 150. A pair of first plating solution transfer lines 181 may be disposed corresponding to the spray nozzles 160 disposed on both surfaces of the anode 150.

The power supply unit POWER is electrically connected to the cathode 140 and the anode 150 and applies a current. For example, the power supply unit POWER may apply a voltage to the cathode 140 and the anode 150 to allow a constant current to flow between the cathode 140 and the anode 150. Because the constant current flows between the cathode 140 and the anode 150, a plating layer uniform in thickness and surface profile may be formed.

The power supply unit POWER may apply a constant voltage such as a direct current (DC) voltage to the anode 150 and apply an alternating current (AC) voltage to the cathode 140. Herein, the AC voltage may have various waveforms such as a sine wave, a pulse wave, or a triangle wave. For example, the power supply unit POWER may apply the same voltage to the first cathode 140A and the second cathode 140B disposed facing each other among the plurality of first cathodes 140A and the plurality of second cathodes 140B. For example, as the anode 150 moves, a current flowing between the first cathode 140A and the anode 150 and a current flowing between the second cathode 140B and the anode 150 may be changed. However, the sum of the current flowing between the anode 150 and the first cathode 140A as well as the current flowing between the anode 150 and second cathode 140B disposed facing the first cathode 140A may be constant.

The controller CONTROL is connected to the power supply unit POWER and controls currents applied from the power supply unit POWER to the cathode 140 and the anode 150. For example, the controller CONTROL may regulate current densities generated by the cathode 140 and the anode 150 to control the thickness and surface profile of a plating layer.

For example, the controller CONTROL may regulate a current density to be applied to the cathode 140 depending on a position of the anode 150 moving between the first cathode 140A and the second cathode 140B disposed facing each other. The controller CONTROL may sense a position of the anode 150. Then, the controller CONTROL may regulate a voltage to be applied to the plurality of cathodes 140 or turn on/off the cathodes 140 based on the area of plating on the substrate 130 corresponding to the position of the anode 150. Otherwise, voltages to be applied to the plurality of cathodes 140 according to a change in position of the anode 150 may be stored in a memory of the controller CONTROL in advance. When the position of the anode 150 is changed, the controller CONTROL may regulate a voltage to be applied to the plurality of cathodes 140 or turn on/off the cathodes 140 based on the data stored in the memory. Thus, the controller CONTROL may regulate or adjust the amount of current to be applied to each plating region to regulate the amount and thickness of a plating layer to be formed on the plating region.

In the electroplating apparatus 100 according to an embodiment of the present disclosure, a constant current may flow between the cathode 140 and the anode 150, and, thus, a plating layer uniform in thickness and surface profile may be formed. A DC voltage may be applied to the anode 150 and an AC voltage may be applied to the cathode 140. For example, to maintain a constant current between the anode 150 the cathode 140, the controller CONTROL may regulate the intensity of a voltage applied to the first cathode 140A and the second cathode 140B facing each other. Thus, the sum of currents applied to the first cathode 140A and the second cathode 140B may be constant.

Figure 5:
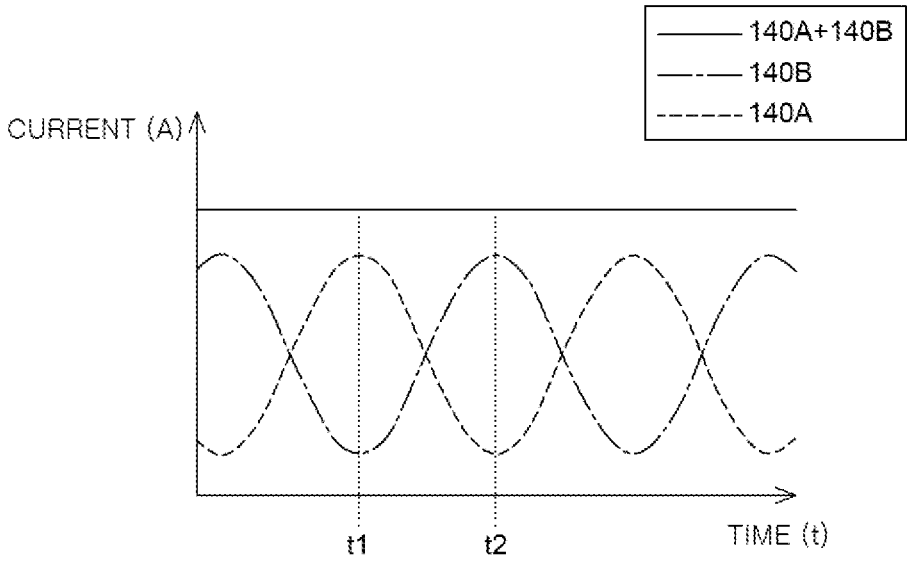
FIG. 5 is a graph provided to explain a current applied to a cathode of the electroplating apparatus according to an embodiment of the present disclosure.

FIG. 5 is a graph provided to explain a current applied to a cathode of the electroplating apparatus according to an embodiment of the present disclosure. For example, FIG. 5 illustrates currents applied through the first cathode 140A and the second cathode 140B facing each other.

With reference to FIG. 5, an AC voltage is applied to the first cathode 140A and the second cathode 140B. As may be seen, the sum of the current flowing between the first cathode 140A and the anode 150 and the current flowing between the second cathode 140B and the anode 150 can be maintained constant.

For example, the same voltage may be applied to the first cathode 140A and the second cathode 140B. For example, when the anode 150 is located closest to the first cathode 140A and farthest from the second cathode 140B (t1), a resistance between the first cathode 140A and the anode 150 is minimum. Thus, a current flowing between the first cathode 140A and the anode 150 is maximum. As another example, the anode 150 is located farthest from the second cathode 140B, and, thus, a resistance between the second cathode 140B and the anode 150 is maximum and a current flowing between the second cathode 140B and the anode 150 is minimum.

Then, as the anode 150 moves from the side of the first cathode 140A toward the side of the second cathode 140B, the resistance between the first cathode 140A and the anode 150 may gradually increase. Thus, the current flowing between the first cathode 140A and the anode 150 may gradually decrease.

Then, when the anode 150 is located closest to the second cathode 140B and farthest from the first cathode 140A (t2), the resistance between the second cathode 140B and the anode 150 is minimum. Thus, the current flowing between the second cathode 140B and the anode 150 is maximum. As another example, because the anode 150 is located farthest from the first cathode 140A, the resistance between the first cathode 140A and the anode 150 is maximum and the current flowing between the first cathode 140A and the anode 150 is minimum.

The vertical electroplating method has been used for electroplating. According to the vertical electroplating method, a connection between a cathode and a seed pattern of a substrate is made on only one side of the substrate. Therefore, a contact between the cathode and the seed pattern is made at a single point. Thus, a resistance of the seed pattern increases away from a contact portion between the cathode and the seed pattern. Therefore, according to the vertical electroplating method, it is very difficult to form a uniform plating layer on the entire substrate. Further, according to the vertical electroplating method, the substrate is disposed in a vertical direction. Thus, a gas such as hydrogen and a by-product such as salt generated during the plating process may be accumulated in the vertical direction. For example, obstacles to plating may be accumulated. Furthermore, according to the vertical electroplating method, the substrate 130 being transferred in a horizontal direction is rotated to the vertical direction in order to load the substrate into a plating bath. After the plated substrate is unloaded from the plating bath, the substrate is rotated again to the horizontal direction. Therefore, the plating bath and its peripheral devices may become bulky.

The electroplating apparatus 100 according to an embodiment of the present disclosure performs a plating process by a horizontal electroplating method to solve the above-described problems of the vertical electroplating method. For example, the plurality of cathodes 140 of the electroplating apparatus 100 according to an embodiment of the present disclosure may be disposed on first and second sides of the substrate 130. For example, the plurality of first cathodes 140A may be disposed on one side of the substrate 130 and the plurality of second cathodes 140B may be disposed on the other side of the substrate 130. Thus, the plurality of cathodes 140 may be electrically connected to the seed pattern on the substrate 130. Therefore, a resistance of the seed pattern may be maintained constant due to multi-contacts between the cathodes 140 and the seed pattern. Thus, in the electroplating apparatus 100 according to an embodiment of the present disclosure, the current density may be maintained uniform throughout the substrate 130 and a uniform plating layer may be formed.

Further, the electroplating apparatus 100 according to an embodiment of the present disclosure performs a plating process by the horizontal electroplating method to reduce or minimize the accumulation of obstacles to plating. For example, in the electroplating apparatus 100 according to an embodiment of the present disclosure, the substrate 130 is disposed in the horizontal direction. Thus, the surface of the substrate 130 may be disposed substantially parallel to the surface of the plating solution SOL. Therefore, it is possible to reduce or minimize the vertically accumulation of a gas or by-product generated during the plating process.

Furthermore, the electroplating apparatus 100 according to an embodiment of the present disclosure performs a plating process by the horizontal electroplating method to reduce or minimize the volume of the system. If in-line processes are used in a manufacturing process, a manufacturing target, e.g., a substrate, is moved in the horizontal direction during the manufacturing process. Thus, if the electroplating apparatus performs a plating process by the horizontal electroplating method, the substrate being disposed in the horizontal direction can be loaded into the plating bath. After the plated substrate is unloaded from the plating bath, the substrate may be moved as it is to a cleaning device or equipment. Thus, in the electroplating apparatus 100 according to an embodiment of the present disclosure, any device for rotating the substrate 130 from the horizontal direction to the vertical direction or vice versa is not required. Therefore, the volume of the system can be reduced. According to one embodiment of the vertical electroplating method, the plating bath has a size more than double the lengthwise dimension of the substrate. However, according to one embodiment of the horizontal electroplating method as in the electroplating apparatus 100 according to an embodiment of the present disclosure, the plating bath 110 may have a size much smaller than the double of the size of the substrate 130. Thus, in the electroplating apparatus 100 according to an embodiment of the present disclosure, the size of the plating bath 110 can be reduced to minimize the volume of the system.

In the electroplating apparatus 100 according to an embodiment of the present disclosure, the cathode 140 may be composed of the plurality of cathodes 140, and, thus, different current for respective plating regions can be achieved. For example, the cathode 140 may include the plurality of first cathodes 140A disposed on one side of the substrate 130 and the plurality of second cathodes 140B disposed on the other side of the substrate 130. Voltages applied to the plurality of first cathodes 140A and the plurality of second cathodes 140B respectively facing each other may be controlled. Thus, the cathode 140 may implement different current for respective plating regions. For example, to implement a higher current in a plating region corresponding to the leftmost first cathode 140A and second cathode 140B among the plurality of first cathodes 140A and the plurality of second cathodes 140B than in a plating region corresponding to the first cathode 140A and second cathode 140B located next to the leftmost ones, a voltage applied to the leftmost first cathode 140A and second cathode 140B may be adjusted to be higher than a voltage applied to the first cathode 140A and second cathode 140B located next to the leftmost ones. As such, when a voltage applied to one of the first cathodes 140A and one of the second cathodes 140B is set to be different from a voltage applied to another one of the first cathodes 140A and another one of the second cathodes 140B, a current in the plating region corresponding to one of the first cathodes 140A and another one of the second cathodes 140B can be different from a current in the plating region corresponding to another one of the first cathodes 140A and another one of the second cathodes 140B. Thus, as shown in FIG. 4, if five pairs of cathodes are disposed, it is possible to implement different currents for five plating regions, respectively.

If one single cathode is disposed on one side of the substrate and another single cathode is disposed on the other side of the substrate, a single voltage is applied through the cathode to all of plating regions. Therefore, different current for respective plating regions may not be achieved. That is, if a single cathode is disposed on each of the both sides of the substrate, the same current is implemented for the entire region of the substrate.

However, in the electroplating apparatus 100 according to an embodiment of the present disclosure, since the plurality of first cathodes 140A is disposed on one side of the substrate and the plurality of second cathodes 140B is disposed on the other side of the substrate, different current for respective plating regions may be achieved compared to the case where a single first cathode is disposed on one side of the substrate and a single second cathode is disposed on the other side of the substrate.

In the electroplating apparatus 100 according to an embodiment of the present disclosure, different current for respective plating regions may be achieved using the plurality of first cathodes 140A and the plurality of second cathodes 140B. Therefore, in the electroplating apparatus 100 according to an embodiment of the present disclosure, a plating layer with a uniform thickness can be formed on the substrate 130.

For example, the area of plating in a plating region corresponding to the leftmost first cathode 140A and second cathode 140B may be larger than the area of plating in a plating region corresponding to the first cathode 140A and second cathode 140B located next to the leftmost ones. For example, assuming that a plating layer with a plating area of 1 $cm^2$ may be formed in the plating region corresponding to the leftmost first cathode 140A and second cathode 140B and a plating layer with a plating area of about 1 $mm^2$ may be formed in the plating region corresponding to the first cathode 140A and second cathode 140B located next to the leftmost ones, a seed pattern disposed on the substrate 130 in the plating region corresponding to the leftmost first cathode 140A and second cathode 140B may be greater in size than a seed pattern disposed on the substrate 130 in the plating region corresponding to the first cathode 140A and second cathode 140B located next to the leftmost ones. However, if a current in the plating region corresponding to the leftmost first cathode 140A and second cathode 140B may be the same as a current in the plating region corresponding to the first cathode 140A and second cathode 140B located next to the leftmost ones, a current density of the seed pattern in the plating region corresponding to the first cathode 140A and second cathode 140B located next to the leftmost ones may be greater than a current density of the seed pattern in the plating region corresponding to the leftmost first cathode 140A and second cathode 140B. In this case, a plating layer formed in the plating region corresponding to the leftmost first cathode 140A and second cathode 140B may have a smaller thickness than a plating layer formed on the plating region corresponding to the first cathode 140A and second cathode 140B located next to the leftmost ones due to a difference in current density. Therefore, a plating layer with different thicknesses for the respective plating regions may be formed. Thus, the plating layer may not have a uniform thickness.

However, in the electroplating apparatus 100 according to an embodiment of the present disclosure, different currents for respective plating regions can be achieved in consideration of the area of plating in each plating region. For example, the area of plating in a plating region corresponding to the leftmost first cathode 140A and second cathode 140B may be greater than the area of plating in a plating region corresponding to the first cathode 140A and second cathode 140B located next to the leftmost ones. In this case, a higher current may be applied to the plating region corresponding to the leftmost first cathode 140A and second cathode 140B than to the plating region corresponding to the first cathode 140A and second cathode 140B located next to the leftmost ones. Thus, a current density can be uniform in the plating region corresponding to the leftmost first cathode 140A and second cathode 140B and the plating region corresponding to the first cathode 140A and second cathode 140B located next to the leftmost ones. Therefore, in the electroplating apparatus 100 according to an embodiment of the present disclosure, the overall thickness of a plating layer can be uniform, and a difference in thickness of the plating layer caused by a difference in the area of plating can be reduced or minimized. Therefore, a plating layer uniform in thickness and surface profile can be formed.

Further, in the electroplating apparatus 100 according to an embodiment of the present disclosure, the level of a voltage applied to a pair of cathodes may be controlled. Thus, a difference in thickness of a plating layer in a plating region corresponding to the pair of cathodes can be reduced or minimized. For example, in the plating region corresponding to the leftmost first cathode 140A and second cathode 140B, as the anode moves, the area of plating may be changed. For example, the area of plating in the plating region corresponding to the leftmost first cathode 140A and second cathode 140B may be 1 $cm^2$ at a first time point, and the area of plating in the plating region corresponding to the leftmost first cathode 140A and second cathode 140B may be about 1 $mm^2$ at a second time point after the first time point. However, if the leftmost first cathode 140A and second cathode 140B are applied with the same voltage at the first time point and the second time point, a plating layer with a smaller thickness may be formed at the first time point and a plating layer with a greater thickness may be formed at the second time point. Thus, a voltage applied to the leftmost first cathode 140A and second cathode 140B at the second time point may be smaller than a voltage applied to the leftmost first cathode 140A and second cathode 140B at the first time point in order to implement a uniform current density even when the anode moves. Thus, in the electroplating apparatus 100 according to an embodiment of the present disclosure, the overall thickness of a plating layer can be uniform, and a difference in thickness of the plating layer caused by a difference in the area of plating can be reduced or minimized. Therefore, a plating layer uniform in thickness and surface profile can be formed.

Figure 6:
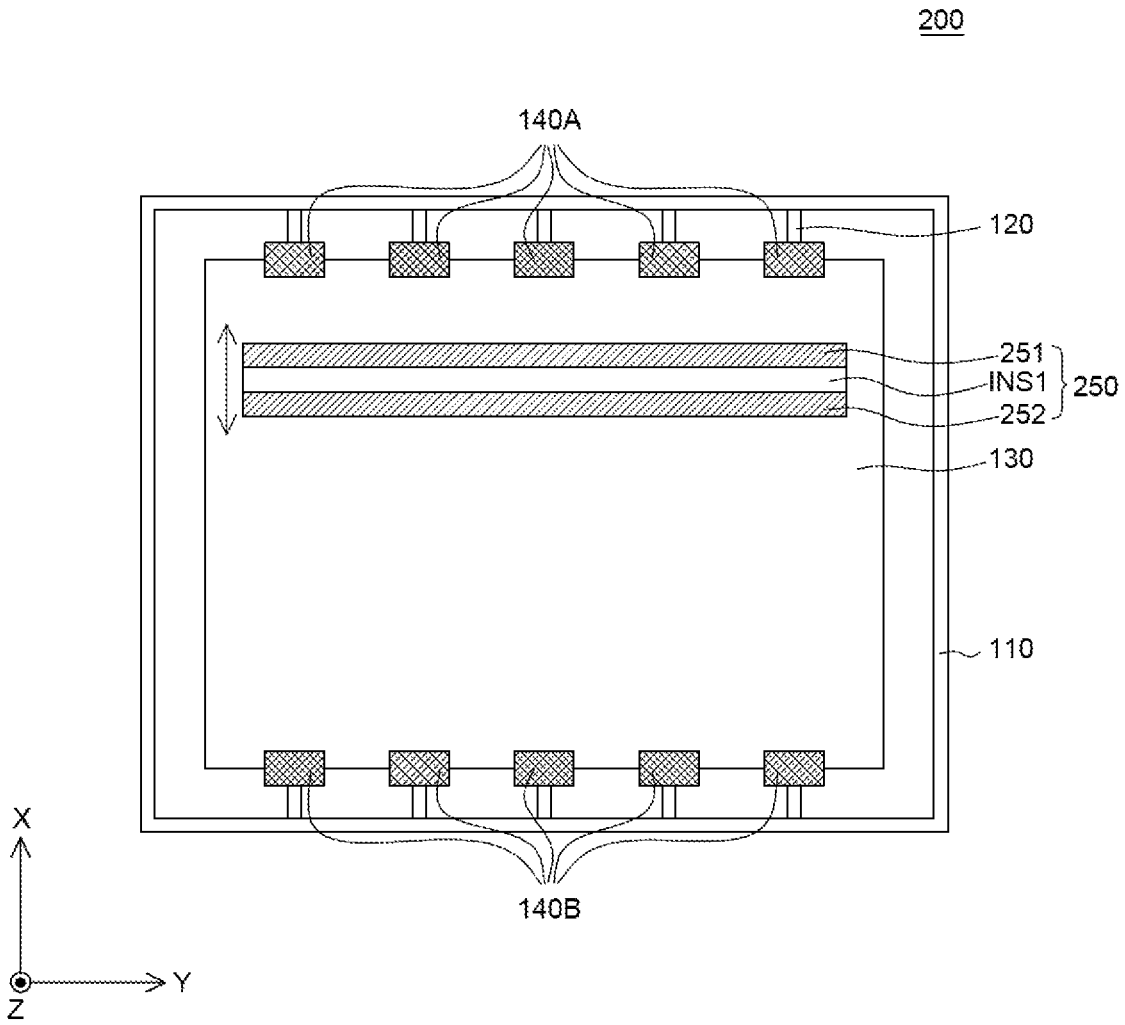
FIG. 6 is a plan view of an electroplating apparatus according to another embodiment of the present disclosure.
Figure 7:
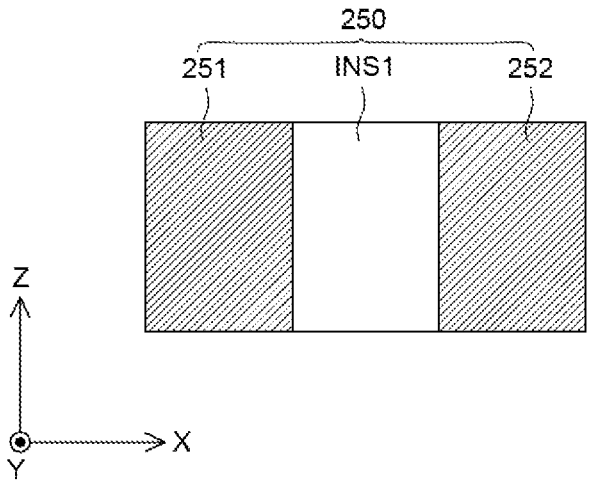
FIG. 7 is a cross-sectional view as taken along an X-Z plane of FIG. 6.

FIG. 6 is a plan view of an electroplating apparatus according to another embodiment of the present disclosure. FIG. 7 is a cross-sectional view as taken along an X-Z plane of FIG. 6. An electroplating apparatus 200 shown in FIG. 6 is substantially the same as the electroplating apparatus 100 shown in FIG. 1 except for an anode 250. Therefore, a repetitive description thereof will be omitted.

With reference to FIG. 6, in the electroplating apparatus 200 according to another embodiment of the present disclosure, the anode 250 includes a plurality of sub-anodes 251 and 252.

The sub-anodes 251 and 252 form a unit block of the anode 250. For example, the anode 250 may be divided in the X-axis direction. For example, a first sub-anode 251 and a second sub-anode 252 are extended in the Y-axis direction and have the same Y-axis directional length as the anode 250. Thus, the sub-anodes 251 and 252 may have a rectangular shape whose width along the X-axis direction as the movement direction of the anode 250 is smaller than the Y-axis directional length. The sub-anodes 251 and 252 may have a rectangular shape whose X-axis directional width is smaller than the Z-axis directional height. Therefore, the sub-anodes 251 and 252 may have a rectangular parallelepiped shape whose X-axis directional width is smaller than the Y-axis directional length and the Z-axis directional height.

The plurality of sub-anodes 251 and 252 may be spaced apart from each other in the X-axis direction. Thus, the plurality of sub-anodes 251 and 252 may be disposed in parallel at a predetermined distance from each other.

For example, a voltage may be applied independently to each of the plurality of sub-anodes 251 and 252. For example, the plurality of sub-anodes 251 and 252 may be applied independently with a voltage through separate lines, respectively. Thus, the same voltage or different voltages may be applied to the plurality of sub-anodes 251 and 252. A voltage may be applied to some of the plurality of sub-anodes 251 and 252 and may not be applied to the others.

For example, an insulating layer INS1 may be disposed between the plurality of sub-anodes 251 and 252 spaced apart from each other. Therefore, the plurality of sub-anodes 251 and 252 and the insulating layer INS1 are disposed alternately in the X-axis direction. The insulating layer INS1 insulates the plurality of sub-anodes 251 and 252 adjacent thereto and maintains a constant distance between the sub-anodes 251 and 252. The insulating layer INS1 may be formed of an insulating material capable of electrically insulating the two sub-anodes 251 and 252 adjacent thereto. For example, the insulating layer INS1 may be formed of an organic polymer having insulating properties or an inorganic material such as silicon nitride (SiNx) or silicon oxide (SiOx), but is not limited thereto.

In some embodiments, the insulating layer INS1 disposed between the plurality of sub-anodes 251 and 252 may not be provided. Even if the insulating layer INS1 is not provided, the plurality of sub-anodes 251 and 252 may be applied independently with a voltage as described above. Therefore, the plurality of sub-anodes 251 and 252 may be electrically insulated. Because the insulating layer INS1 is disposed between the plurality of sub-anodes 251 and 252, electrical insulation between the plurality of sub-anodes 251 and 252 can be secured more reliably.

In the electroplating apparatus 200 according to another embodiment of the present disclosure, the anode 250 includes the plurality of sub-anodes 251 and 252. The anode 250 may be used to obtain a profile where a current density in a central portion of the anode 250 is uniform. Thus, the electroplating apparatus 200 according to another embodiment of the present disclosure may form a plating layer uniform in thickness and composition ratio of metal in the plating layer.

The effects of the electroplating apparatus according to another embodiment of the present disclosure will be described in more detail with reference to FIG. 8A through FIG. 9.

Figure 8A:
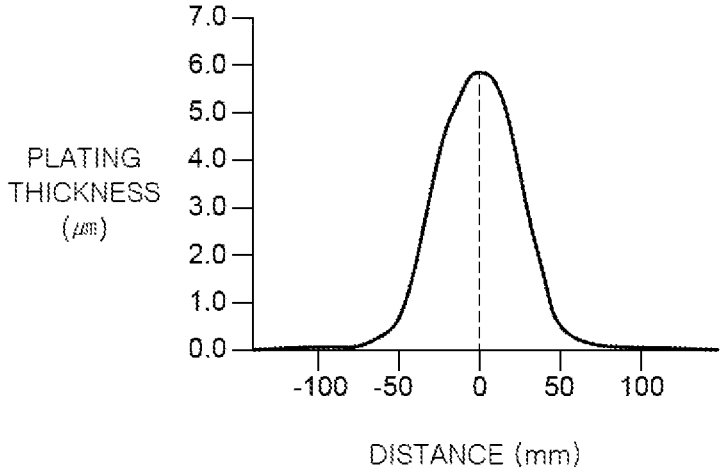
FIG. 8A through FIG. 8C are graphs respectively showing the thickness, composition ratio and Z-axis directional current density of a plating layer formed by an electroplating apparatus according to Comparative Example 1.
Figure 8B:
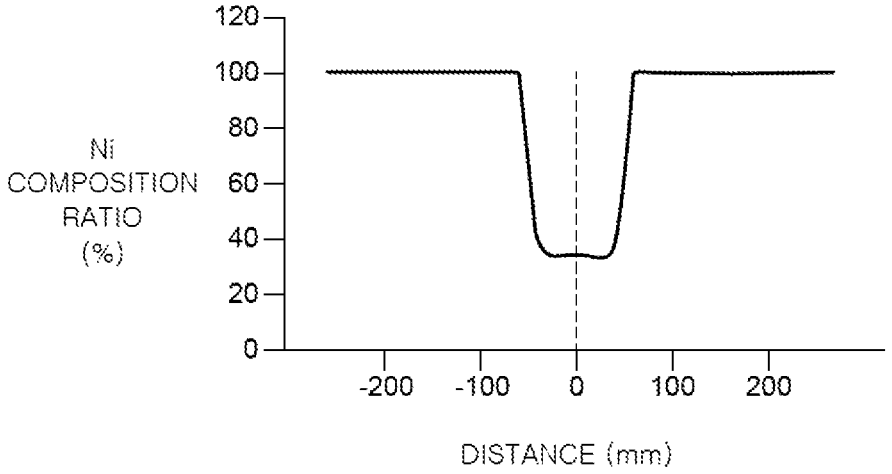
Figure 8C:
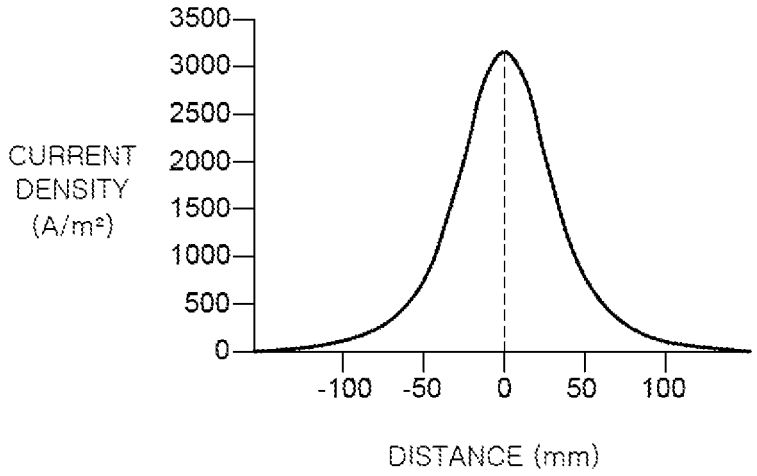

FIG. 8A through FIG. 8C are graphs respectively showing the thickness, composition ratio and Z-axis directional current density of a plating layer formed by an electroplating apparatus according to Comparative Example 1.

Comparative Example 1 is an electroplating apparatus including a single anode. For example, the X-axis directional width of the anode is about 40 mm. A plating process was performed using the electroplating apparatus according to Comparative Example 1 while the distance between the substrate and the anode was maintained at about 30 mm.

FIG. 8A shows the measurement result of the X-axis directional thickness of the plating layer based on the center of the anode when plating was performed using the electroplating apparatus according to Comparative Example 1 including a single anode. With reference to FIG. 8A, it may be shown that the thickness of the plating layer sharply decreases as being away from the center of the anode. The plating layer formed by electroplating apparatus according to Comparative Example 1 may have a thickness distribution similar to the Gaussian distribution. With reference to FIG. 8A, it is shown that when electroplating apparatus according to Comparative Example 1 is used, it is difficult to uniformly control the thickness of the plating layer.

FIG. 8B shows the measurement result of the composition ratio of nickel in the plating layer along the X-axis direction based on the center of the anode when plating was performed using the electroplating apparatus according to Comparative Example 1. With reference to FIG. 8B, it may be shown that the content of nickel is maintained constant at about 37% in the range of about +/−50 mm from the center of the anode. Further, it may be shown that the content of nickel sharply increases as being farther than about 50 mm from the center of the anode. With reference to the result shown in FIG. 8B, it is shown that when the electroplating apparatus according to Comparative Example 1 is used, the plating layer does not have uniform properties and the content of nickel in a very small region can be maintained at about 37%.

FIG. 8C shows the simulation result of a current density generated when the anode is fixed based on the measurement results of FIG. 8A and FIG. 8B in the electroplating apparatus according to Comparative Example 1. With reference to FIG. 8C, as for a single anode with a width of about 40 mm, a current density distribution in the Z-axis direction is similar to the Gaussian distribution. For example, the current density sharply decreases as being away from the center of the anode. It is difficult for the electroplating apparatus according to Comparative Example 1 to form a plating layer uniform in thickness, surface profile, and composition ratio of nickel due to non-uniform current density.

A mask for deposition of an organic layer may be manufactured using an electroplating apparatus and the mask may be formed of Invar. For example, it is very important to realize a uniform composition ratio of nickel forming Invar in the range of from about 36% to about 40%. The mask for deposition of an organic layer is used in a heated environment instead of at room temperature. Further, the organic layer is deposited accurately at a desired position using the mask, and, thus, a pattern shape of the mask is very precisely formed. If the size or shape of the pattern changes as the temperature changes, it is impossible to accurately deposit the organic layer at a desired position. Thus, if a mask is formed of Invar by electroplating, the composition ratio of nickel in the mask is maintained uniform in the range of from about 36% to about 40% to reduce or minimize a change in size of the mask as the temperature changes. If the composition ratio of nickel in the mask is out of the range of from about 36% to about 40%, a thermal expansion coefficient of the mask sharply increases. For example, it is impossible to deposit an organic layer accurately at a desired position in a process of depositing an organic layer using the mask.

In Comparative Example 1, the Z-axis directional current density sharply decreases as being away from the center of the anode. Therefore, as shown in FIG. 8B, the composition ratio of nickel in a very narrow region may be maintained uniform in the range of from about 36% to about 40%. Thus, when a mask is manufactured using the electroplating apparatus according to Comparative Example 1, the composition ratio of nickel in the mask may be not uniform. Therefore, it is impossible to deposit an organic layer more accurately using the mask.

Figure 9:
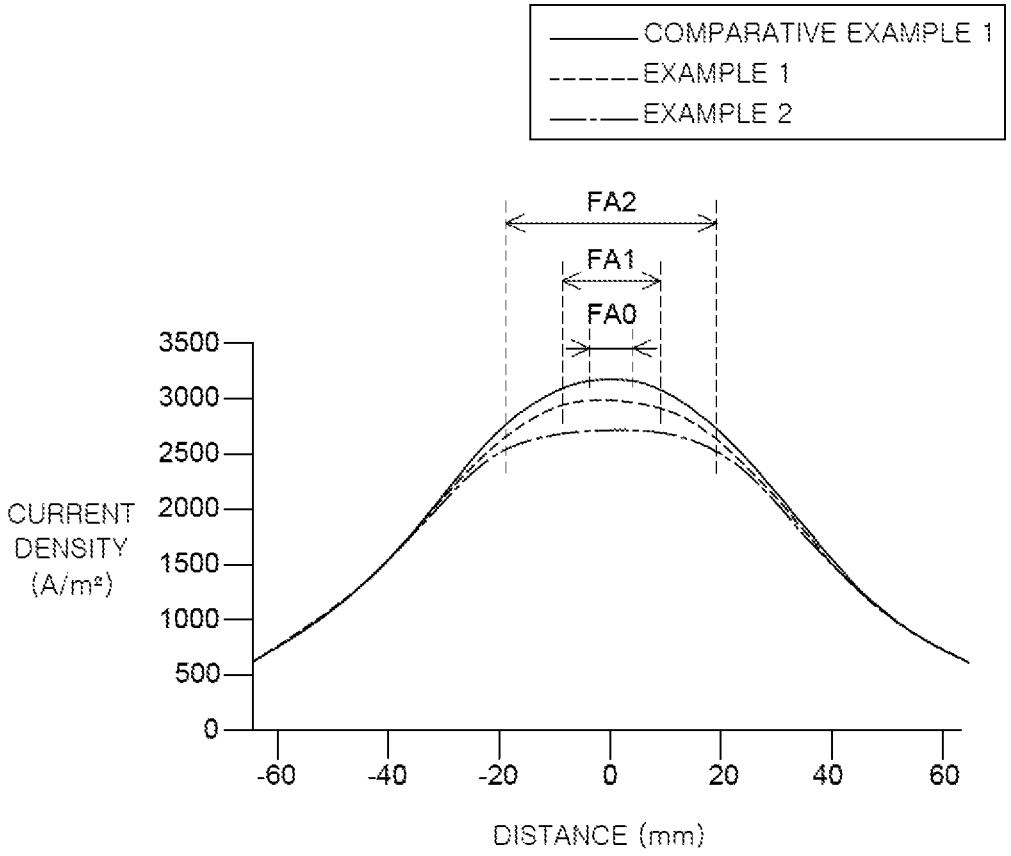
FIG. 9 is a graph showing the current density along a Z-axis direction based on the center of an anode in each of electroplating apparatuses according to Examples 1 and 2 and Comparative Example 1, respectively.

FIG. 9 is a graph showing the current density along a Z-axis direction based on the center of an anode in each of electroplating apparatuses according to Examples 1 and 2 and Comparative Example 1, respectively.

Example 1 is an electroplating apparatus according to yet another embodiment of the present disclosure. The electroplating apparatus includes a first sub-anode extended in the Y-axis direction and a second sub-anode extended in the Y-axis direction and spaced apart from the first sub-anode in the X-axis direction. For example, each of the first sub-anode and the second sub-anode has a width about of 10 mm and a distance between the first sub-anode and the second sub-anode is about 20 mm.

Example 2 is an electroplating apparatus according to another embodiment of the present disclosure. The electroplating apparatus includes a first sub-anode extended in the Y-axis direction, a second sub-anode extended in the Y-axis direction and spaced apart from the first sub-anode in the X-axis direction, and an insulating layer between the first sub-anode and the second sub-anode. For example, each of the first sub-anode and the second sub-anode has a width of about 10 mm and the insulating layer has a width of about 20 mm.

A plating process was performed using the electroplating apparatuses according to Examples 1 and 2, respectively, while the distance between the substrate and the anode was maintained at about 30 mm. Simulation on a current density formed when the anode was fixed was performed using the formed plating layer.

With reference to FIG. 9, it may be shown that in Example 1 where a plurality of anodes is spaced apart from each other as compared to Comparative Example 1, a decrease in Z-axis directional current density is reduced as being away from the center of the anode. For example, it may be shown that in Example 1 of the present disclosure as compared to Comparative Example 1 including a single anode, a region with a uniform Z-axis directional current density further increases in size based on the center of the anode. Herein, the region with a uniform current density may be a region whose deviation of the Z-axis directional current density based on the center of the anode is within about 5% of the highest current density. Therefore, in Example 1 of the present disclosure, a sharp decrease in current density as being away from the center of the anode can be suppressed. Thus, in Example 1 of the present disclosure as compared to Comparative Example 1, a plating layer uniform in thickness, surface profile, and composition ratio of nickel can be formed.

Further, in Example 2 of the present disclosure including the insulating layer between the plurality of anodes as compared to Comparative Example 1 and Example 1 of the present disclosure, a Z-axis directional current density is formed more uniformly based on the center of the anode. For example, it may be shown that a region FA2 with a uniform current density based on the center of the anode according to Example 2 of the present disclosure is greater than a region FA0 with a uniform current density according to Comparative Example 1. Further, it may be shown that the region FA2 with a uniform current density based on the center of the anode according to Example 2 of the present disclosure is greater than a region FA1 with a uniform current density according to Example 1 of the present disclosure. Therefore, the electroplating apparatus according to Example 2 of the present disclosure including the insulating layer between the plurality of anodes can obtain a uniform current density in a wider region based on the center of the anode. Thus, it is possible to form a plating layer uniform in thickness, surface profile, and composition ratio of nickel.

Thus, Examples 1 and 2 of the present disclosure may have a wider region with a uniform Z-axis directional current density based on the center of the anode than Comparative Example 1. For example, as shown in FIG. 9, Examples 1 and 2 have a wider region with a uniform current density based on the center of the anode than Comparative Example 1. Therefore, Examples 1 and 2 of the present disclosure may have a relatively wide region with a uniform composition ratio of nickel in the range of from about 36% to about 40%. Thus, if a mask is manufactured using the electroplating apparatuses according to Examples 1 and 2, respectively, the mask may have a relatively uniform composition ratio of nickel. Therefore, if the mask manufactured using the electroplating apparatuses according to Examples 1 and 2 is used, a change in shape and size of the mask caused by a change in temperature can be reduced or minimized. Thus, it is possible to more precisely deposit an organic layer.

Figure 10:
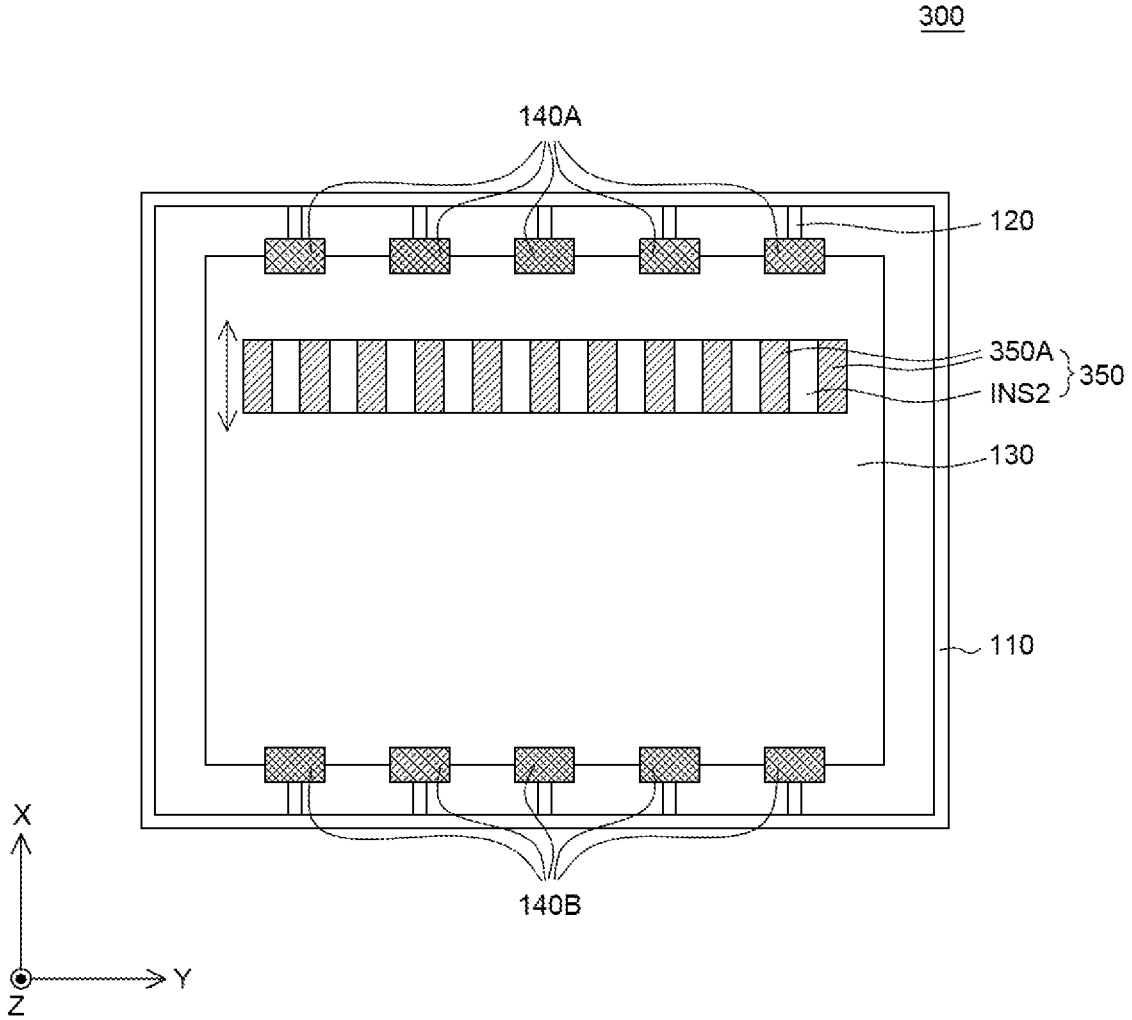
FIG. 10 is a plan view of an electroplating apparatus according to another embodiment of the present disclosure.

FIG. 10 is a plan view of an electroplating apparatus according to yet another embodiment of the present disclosure. An electroplating apparatus 300 shown in FIG. 10 is substantially the same as the electroplating apparatus 200 shown in FIG. 6 except for an anode 350. Therefore, a repetitive description thereof will be omitted.

With reference to FIG. 10, in the electroplating apparatus 300 according to yet another embodiment of the present disclosure, the anode 350 includes a plurality of sub-anodes 350A.

The electroplating apparatus 200 shown in FIG. 6 includes the plurality of sub-anodes 251 and 252 divided in the X-axis direction. However, the electroplating apparatus 300 shown in FIG. 10 includes the plurality of sub-anodes 350A divided in the Y-axis direction. For example, each of the sub-anodes 350A is extended in the X-axis direction and has the same X-axis directional width as the whole anode 350.

The plurality of sub-anodes 350A is disposed to be spaced apart from each other in the Y-axis direction. Thus, the plurality of sub-anodes 350A may be disposed in parallel at a predetermined distance from each other.

For example, insulating layers INS2 may be disposed respectively between the plurality of sub-anodes 350A spaced apart from each other. Therefore, the plurality of sub-anodes 350A and insulating layers INS2 are disposed alternately in the Y-axis direction. Each insulating layer INS2 insulates the plurality of sub-anodes 350A adjacent thereto and maintains a constant distance between the sub-anodes 350A.

In the electroplating apparatus 300 according to yet another embodiment of the present disclosure, the anode 350 includes the plurality of sub-anodes 350A and the insulating layers INS2 disposed between the plurality of sub-anodes 350A. The anode 350 may be used to obtain a profile where a current density in a central portion of the anode 350 is uniform. Thus, the electroplating apparatus 300 according to another embodiment of the present disclosure can form a plating layer uniform in thickness and composition ratio of metal in the plating layer.

As the distance between the plurality of sub-anodes 350A increases, the area of a region with a uniform current density may increase. Because it is possible to obtain a uniform current density in a wider region from the center of the anode 350, it is possible to form a plating layer uniform in thickness, surface profile, and composition ratio of nickel.

To implement desired current densities for respective plating regions, the distance between the plurality of sub-anodes 350A may be set to be different partially. For example, the distance between the sub-anodes may be increased by turning off some of the plurality of sub-anodes 350A.

The effects of the electroplating apparatus according to another embodiment of the present disclosure will be described in more detail with reference to FIG. 11.

Figure 11:
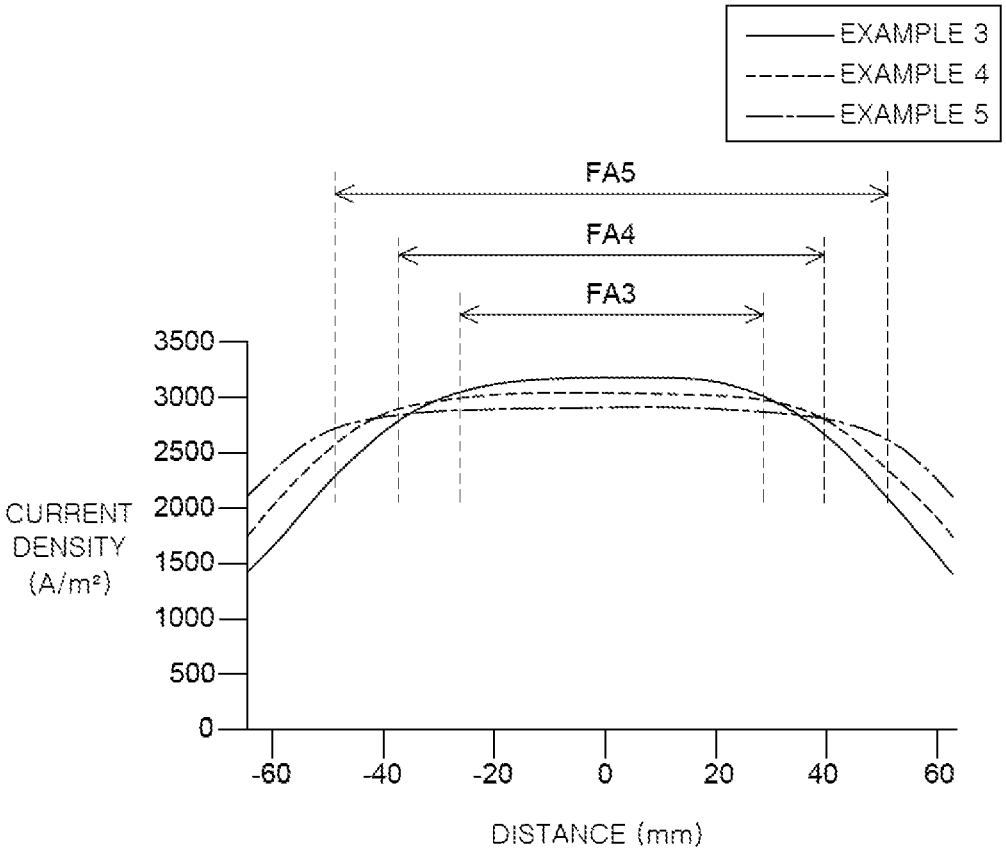
FIG. 11 is a graph showing the current density along a Z-axis direction based on the center of an anode in each of electroplating apparatuses according to Examples 3 through 5, respectively.

FIG. 11 is a graph showing the current density along a Z-axis direction based on the center of an anode in each of electroplating apparatuses according to Examples 3 through 5, respectively.

In Example 3 of the present disclosure, a plurality of sub-anodes which is extended in the X-axis direction and spaced at a predetermined distance from each other in the Y-axis direction is included. For example, the Y-axis directional length of each sub-anode is about 10 mm and the distance between the sub-anodes is about 15 mm.

Example 4 of the present disclosure is substantially the same as Example 3 except that an anode includes sub-anodes spaced apart from each other at a distance of about 20 mm.

Example 5 of the present disclosure is substantially the same as Example 3 except that an anode includes sub-anodes spaced apart from each other at a distance of about 25 mm.

A plating process was performed using the electroplating apparatuses according to Examples 3 through 5, respectively, while the distance between the substrate and the anode was maintained at about 30 mm. Simulation on a current density formed when the anode was fixed was performed using the formed plating layer.

With reference to FIG. 11, Examples 3 through 5 in which a plurality of sub-anodes is spaced in the Y-axis direction include respective regions FA3, FA4, and FA5 with a uniform current density based on the center of the anode.

For example, it may be shown that a region FA4 with a uniform current density according to Example 4 in which the distance between the sub-anodes is about 20 mm is greater than a region FA3 with a uniform current density according to Example 3 in which the distance between the sub-anodes is about 15 mm. Further, it may be shown that a region FA5 with a uniform current density according to Example 5 in which the distance between the sub-anodes is about 25 mm is greater than the region FA4 with a uniform current density according to Example 4 in which the distance between the sub-anodes is about 20 mm. A profile with a uniform current density in a central portion of the anode may be obtained by changing the distance between sub-anodes spaced apart from each other in the Y-axis direction. Thus, it is possible to form a plating layer uniform in thickness and composition ratio of metal in the plating layer.

Figure 12:
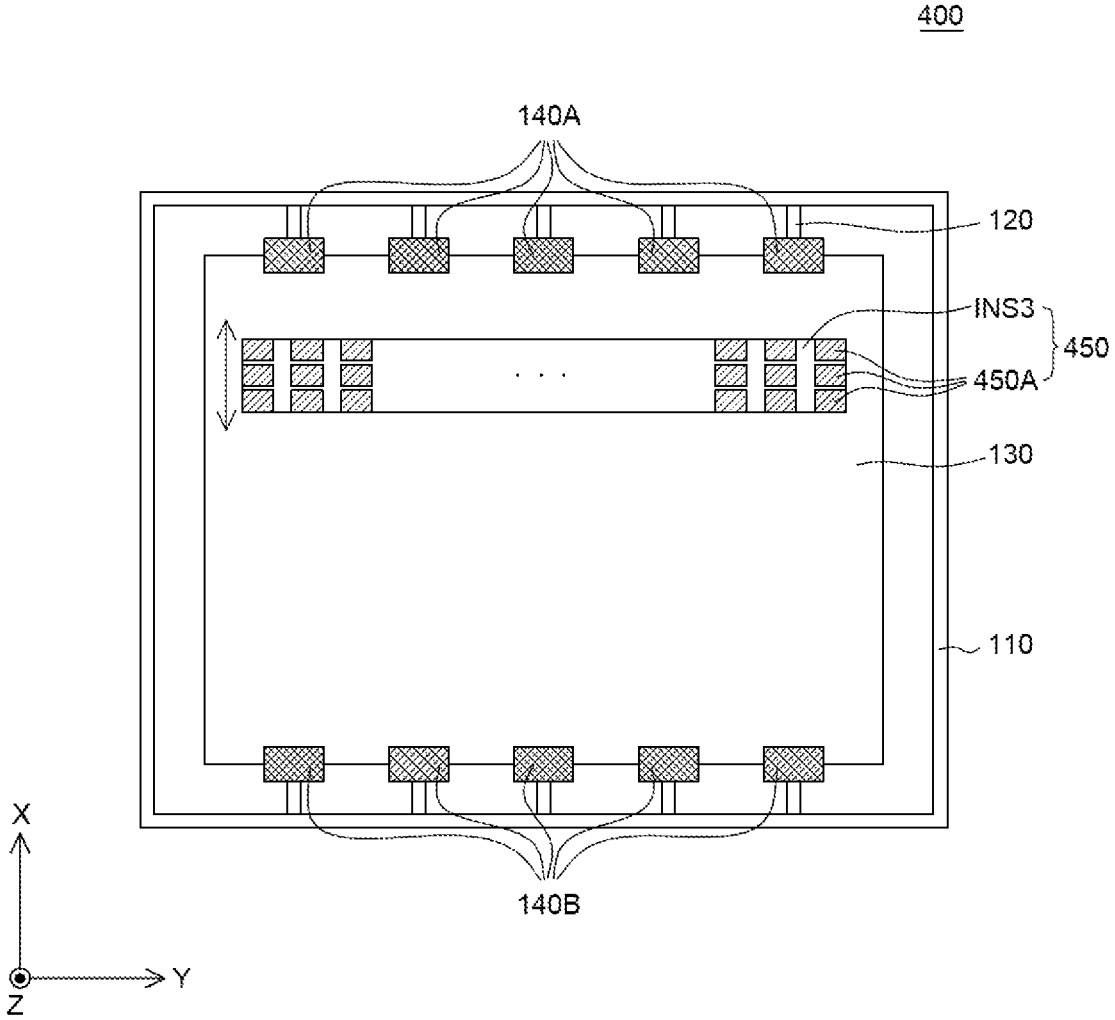
FIG. 12 is a plan view of an electroplating apparatus according to another embodiment of the present disclosure.

FIG. 12 is a plan view of an electroplating apparatus 400 according to another embodiment of the present disclosure. The electroplating apparatus 400 shown in FIG. 12 is substantially the same as the electroplating apparatus 200 shown in FIG. 6 except an anode 450. Therefore, a repetitive description thereof will be omitted.

With reference to FIG. 12, the anode 450 of the electroplating apparatus 400 according to another embodiment of the present disclosure includes a plurality of sub-anodes 450A disposed in a matrix in a plane.

In the electroplating apparatus 400 shown in FIG. 12, M number of sub-anodes are disposed in the X-axis direction and N number of sub-anodes are disposed in the Y-axis direction. For example, the plurality of sub-anodes 450A may be disposed in a matrix of M×N on the flat plane. In this case, M is an integer of 2 or more and N is an integer of 2 or more.

The plurality of sub-anodes 450A disposed in a matrix and disposed to be spaced apart from each other in the X-axis direction and the Y-axis direction. In this case, insulating layers INS3 may be disposed respectively between the plurality of sub-anodes 450A spaced apart from each other. Therefore, the insulating layers INS3 between the plurality of sub-anodes 450A may be disposed in a mesh form. Each insulating layer INS3 insulates the plurality of sub-anodes 450A adjacent thereto in the Y-axis direction as well as the X-axis direction and maintains a constant distance between the sub-anodes 450A.

In the electroplating apparatus 400 according to another embodiment of the present disclosure, the plurality of sub-anodes 450A disposed in a matrix may be connected respectively to switches which operate independently. The controller CONTROL controls ON/OFF operation of each switch to apply a voltage independently to each of the sub-anodes 450A. By controlling each of the sub-anodes 450A independently, a current between the sub-anode 450A and the cathode 140 can be formed differently for each region of all the sub-anodes 450A.

The electroplating apparatus 400 according to another embodiment of the present disclosure uses the plurality of sub-anodes 450A disposed in a matrix. Thus, it is possible to obtain a profile where a current density in a central portion of the anode 450 is uniform. Accordingly, the electroplating apparatus 400 according to another embodiment of the present disclosure can form a plating layer uniform in thickness and composition ratio of metal in the plating layer.

Further, the electroplating apparatus 400 according to another embodiment of the present disclosure can control each of the plurality of sub-anodes 450A constituting the anode 450 independently. For example, in the electroplating apparatus 400 according to another embodiment of the present disclosure, the distance between turned-on sub-anodes may be regulated freely by turning off some of the plurality of sub-anodes 450A. Thus, a current density may be regulated freely for each region of the anode 450. Accordingly, it is possible to form a plating layer uniform in thickness and composition ratio of metal in the plating layer.

Electroplating Method

Figure 13:
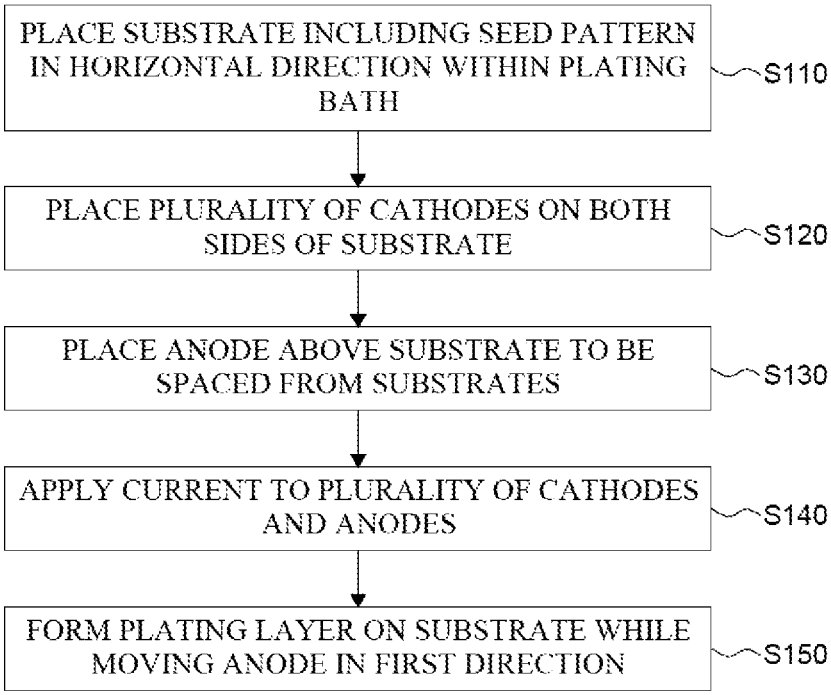
FIG. 13 is a flowchart of an electroplating method according to an embodiment of the present disclosure.

FIG. 13 is a flowchart provided to explain an electroplating method according to an embodiment of the present disclosure. With reference to FIG. 13, an electroplating method according to an embodiment of the present disclosure includes placing a substrate including a seed pattern in a horizontal direction in a plating bath (S110). Further, the electroplating method includes placing a plurality of cathodes on both sides of the substrate (S120) and placing an anode above the substrate to be spaced apart from the substrate (S130). The electroplating method also includes applying a current to the plurality of cathodes and the anode (S140) and forming a plating layer on the substrate while moving the anode in a first direction (S150). The electroplating method according to an embodiment of the present disclosure will be described based on the electroplating apparatus 200 described above with reference to FIG. 6 and FIG. 7, but is not limited thereto. The electroplating method according to an embodiment of the present disclosure may employ the other electroplating apparatuses 100, 300, and 400 according to various embodiments of the present disclosure.

First, the substrate 130 including the seed pattern is disposed in the horizontal direction in the plating bath 110 (S110).

For example, the substrate 130, which is a plating target object, is disposed on the stage 120 located within the plating bath 110. The substrate 130 is disposed in the horizontal direction in the plating bath 110. In this case, the substrate 130 may be disposed such that the surface of the substrate 130 is parallel to the surface of the plating solution SOL in the plating bath 110.

Then, a plurality of cathodes 140 is disposed on both sides of the substrate 130 (S120).

The plurality of cathodes 140 is disposed to be in contact with at least a part of the both sides of the substrate 130. In this case, the plurality of cathodes 140 is connected to the seed pattern on the substrate 130 and applies a current thereto. For example, the plurality of cathodes 140 may include a plurality of first cathodes 140A and a plurality of second cathodes 140B. In this case, the plurality of first cathodes 140A may be disposed on one side of the substrate 130 based on the X-axis direction that is a movement direction of the anode 250. Further, the plurality of second cathodes 140B may be disposed on the other side of the substrate 130. In this case, the first cathodes 140A are disposed facing the second cathodes 140B, respectively. For example, the plurality of first cathodes 140A may be disposed collinearly facing the plurality of second cathodes 140B, respectively.

Then, the plating solution SOL is supplied into the plating bath 110. Thus, the plating bath 110 may be filled with the plating solution SOL. When the plating solution SOL fills in the plating bath 110, the plurality of first cathodes 140A and the plurality of second cathodes 140B may be disposed parallel to the surface of the plating solution SOL. The plurality of cathodes 140 may act as clamps to fix the substrate 130 in place. For example, a virtual plane on which the plurality of first cathodes 140A and the plurality of second cathodes 140B are disposed may be parallel to the surface of the plating solution SOL. Thus, the surface of the substrate 130 may be maintained parallel to the surface of the plating solution SOL.

Then, the anode 250 is disposed on the substrate 130 and spaced apart from the substrate 130 (S130).

The anode 250 is disposed at a predetermined distance from the fixed surface of the substrate 130. In the range where the anode 250 may maintain a constant current with the cathode and have a uniform current density, the distance between the substrate 130 and the anode 250 may be regulated freely. For example, the distance between the substrate 130 and the anode 250 may be about 30 mm, but is not limited thereto.

The spray nozzle 160 may be disposed in combination with the anode 250. For example, the spray nozzle 160 is also disposed to be spaced apart from the surface of the substrate 130 like the anode 250.

Then, a current is applied to the plurality of cathodes 140 and the anode 250 (S140).

For example, a negative voltage is applied to the cathodes 140 and a positive voltage is applied to the anode 250. Thus, a current may be formed between the plurality of cathodes 140 and the anode 250.

The process of applying a current (S140) may include applying a constant current to the seed pattern through the plurality of cathodes 140 and the anode 250. If a constant current flows between the cathodes 140 and the anode 250, a plating layer uniform in thickness and surface profile may be formed.

For example, the process of applying a constant current may include applying a constant voltage to the anode 250 and applying an AC voltage to the plurality of cathodes 140.

For example, the process of applying an AC voltage to the plurality of cathodes 140 may include applying, to the plurality of cathodes 140, an AC voltage which varies in level as the anode 250 moves. To maintain a constant current on the substrate 130 even if a position of the anode 250 is changed, the level of the AC current applied to the plurality of cathodes 140 may be changed according to the change in position of the anode 250.

The process of applying an AC voltage to the plurality of cathodes 140 may further include applying the same voltage to the first cathode 140A and the second cathode 140B disposed facing each other. Because an AC voltage having the same level is applied to the first cathode 140A and the second cathode 140B disposed facing each other, the sum of currents applied to the first cathode 140A and the second cathode 140B may be maintained constant when the anode 250 moves. Further, a constant current may be maintained between the anode 250 and the cathodes 140.

The process of applying an AC voltage to the plurality of cathodes 140 may further include applying a variable AC voltage to each of the plurality of cathodes 140 based on the area of plating under the anode 250 at a position corresponding to each of the plurality of cathodes 140. When the anode 250 moves, a voltage to be applied to the plurality of cathodes 140 is regulated or the cathodes 140 are turned on/off based on the area of plating in a plating region under the anode 250 corresponding to each of the plurality of cathodes 140. A current density may be changed for each plating region, and, thus, the thickness and surface characteristics of a plating layer to be formed on the plating region may be regulated.

The process of applying a constant voltage to the anode 250 may further include applying a voltage independently to each of the plurality of sub-anodes 251 and 252.

For example, with reference to the electroplating apparatus 200 shown in FIG. 6, the electroplating apparatus 200 may use the anode 250 including the plurality of sub-anodes 251 and 252 and the insulating layer INS1 disposed between the plurality of sub-anodes 251 and 252. The insulating layer INS1 insulates the plurality of sub-anodes 251 and 252 and maintains a constant distance between the sub-anodes 251 and 252. For example, it is possible to control the plurality of sub-anodes 251 and 252 independently by applying a voltage to each of the sub-anodes 251 and 252 independently. Accordingly, a current between the anode 250 and the cathode 140 may be formed differently for each region of the whole anode 250.

For example, a voltage may be applied selectively to the plurality of sub-anodes 251 and 252 by turning on/off each of the plurality of sub-anodes 251 and 252. When some sub-anodes are turned off, the distance between sub-anodes applied with a voltage increases. The distance between the sub-anodes 251 and 252 may be changed to obtain a profile where a current density in a central portion of the anode 250 is uniform. Accordingly, it is possible to form a plating layer uniform in thickness and composition ratio of metal in the plating layer.

Then, a plating layer is formed on the substrate 130 while the anode 250 is moved in the X-axis direction (S150).

For example, the connection unit 171 and the driver 172 connected to the anode 250 may be used to move the anode 250 in the X-axis direction. The anode 250 is moved in the X-axis direction in a state where a current is applied to the plurality of cathodes 140 and the anode 250. Thus, a plating layer is formed on the upper surface of the substrate 130 located under the anode 250.

A plating layer may be formed repeatedly by translationally moving the anode 250 in the X-axis direction.

If the spray nozzle 160 is combined with the anode 250, the spray nozzle 160 is moved in the X-axis direction together with the anode 250. The plating solution SOL is supplied from above the substrate 130 through the spray nozzle 160. Thus, it is possible to reduce or minimize a change in concentration of the plating solution SOL in the plating bath 110 and suppress a change in metal content in a plating layer.

The electroplating method according to an embodiment of the present disclosure relates to a horizontal electroplating method by which the plurality of cathodes is disposed on both sides of the substrate. Thus, a resistance of the seed pattern may be maintained constant due to multi-contacts between the cathodes and the seed pattern. Therefore, the current density may be maintained uniform throughout the substrate and a uniform plating layer can be formed. Further, the electroplating method according to an embodiment of the present disclosure may suppress the vertical accumulation of by-products generated during the plating process by placing the surface of the plating solution substantially parallel to the surface of the substrate.

Furthermore, the electroplating method may regulate currents applied to respective plating regions with the plurality of cathodes on the both sides of the substrate and thus change the current density. For example, the electroplating method may achieve different current densities for respective plating regions and thus regulate the thickness and surface characteristics of plating layers to be formed on the respective plating regions.

Moreover, the electroplating method according to an embodiment of the present disclosure uses an anode including a plurality of sub-anodes and insulating layers to selectively apply a voltage to the sub-anodes. Thus, it is possible to obtain a profile where a current density in a central portion of the anode is uniform. Accordingly, it is possible to form a plating layer uniform in thickness and composition ratio of metal in the plating layer.

An embodiment of the present disclosure will be described below.

According to an embodiment of the present disclosure, an electroplating apparatus comprises a plating bath, a substrate in a horizontal direction, a plurality of cathodes on both sides of the substrate in a first direction on one surface of the substrate, and an anode above the substrate, the anode being spaced apart from the substrate and configured to be movable in the first direction.

According to some embodiments of the present disclosure, the plurality of cathodes may include a plurality of first cathodes on a first side of the substrate, a plurality of second cathodes on a second side of the substrate opposing the first side, and each of the plurality of first cathodes may be configured to correspond to each of the plurality of second cathodes.

According to some embodiments of the present disclosure, the electroplating apparatus may further comprise a power supply unit electrically connected to the plurality of cathodes and the anode to apply a current, and a controller configured to control the power supply unit to regulate a voltage to be applied to the plurality of cathodes based on the area of plating on the substrate corresponding to the position of the anode.

According to some embodiments of the present disclosure, a length of the anode in the first direction may be shorter than a length of the anode in a second direction perpendicular to the first direction on the surface of the substrate.

According to some embodiments of the present disclosure, the anode may include a plurality of sub-anodes, the plurality of sub-anodes being spaced apart from each other.

According to some embodiments of the present disclosure, the anode may further include at least one insulating layer between the plurality of sub-anodes.

According to some embodiments of the present disclosure, each of the plurality of sub-anodes may be extended in the second direction, and the plurality of sub-anodes and the at least one insulating layer may be disposed alternately in the first direction.

According to some embodiments of the present disclosure, each of the plurality of sub-anodes may extend in the first direction, and the plurality of sub-anodes and the at least one insulating layer may be disposed alternately in the second direction.

According to some embodiments of the present disclosure, the plurality of sub-anodes is disposed in a matrix on a plane.

According to some embodiments of the present disclosure, the electroplating apparatus may further comprise a stage in a horizontal direction in the plating bath and configured to support the substrate.

According to an embodiment of the present disclosure, a horizontal electroplating apparatus comprises a plating bath having a space where a plating solution is filled, a plurality of first cathodes and a plurality of second cathodes disposed to face each other in the plating bath and configured to apply different current densities to respective plating regions, and an anode overlying the plurality of first cathodes and the plurality of second cathodes, the cathode being configured to be movable between the plurality of first cathodes and the plurality of second cathodes.

According to some embodiments of the present disclosure, when the plating bath is filled with the plating solution, a virtual plane on which the plurality of first cathodes and the plurality of second cathodes may be disposed is parallel to a surface of the plating solution.

According to some embodiments of the present disclosure, the horizontal electroplating apparatus may further include a substrate including a seed pattern in contact with the plurality of first cathodes and the plurality of second cathodes, the substrate being in the plating bath, and when the plating bath is filled with the plating solution, a surface of the plating solution may be parallel to a surface of the substrate.

According to some embodiments of the present disclosure, the horizontal electroplating apparatus may further comprise a power supply unit electrically connected to the plurality of first cathodes, the plurality of second cathodes, and the anode to apply a current, and a controller configured to control the power supply unit.

According to some embodiments of the present disclosure, the anode may include a plurality of sub-anodes spaced apart from each other, the plurality of sub-anodes being separately applied with the voltages.

According to some embodiments of the present disclosure, the anode may further include an insulating layer configured to electrically insulate the plurality of sub-anodes.

According to an embodiment of the present disclosure, an electroplating method comprises placing a substrate including a seed pattern in a horizontal direction in a plating bath, placing a plurality of cathodes on both sides of the substrate in a first direction on one surface of the substrate, placing an anode above the substrate, the anode being spaced apart from the substrate, applying a current to the plurality of cathodes and the anode, and forming a plating layer on the substrate based on a movement of the anode in a first direction.

According to some embodiments of the present disclosure, the applying the current may include applying a constant current to the seed pattern through the plurality of cathodes and the anode.

According to some embodiments of the present disclosure, the applying the current may include applying a constant voltage to the anode and applying an alternating current voltage to the plurality of cathodes.

According to some embodiments of the present disclosure, the applying the alternating current voltage may include applying, to the plurality of cathodes, an alternating current voltage which varies in level as the anode moves.

According to some embodiments of the present disclosure, the plurality of cathodes may include a plurality of first cathodes on a first side of the substrate and a plurality of second cathodes on a second side of the substrate, each of the plurality of first cathodes may correspond to each of the plurality of second cathodes.

According to some embodiments of the present disclosure, the applying the alternating current voltage may include applying, to each of the plurality of cathodes, an alternating current voltage which varies depending on the area of plating under the anode at a position corresponding to each of the plurality of cathodes.

According to some embodiments of the present disclosure, the anode may include a plurality of sub-anodes and at least one insulating layer between the plurality of sub-anodes, and the applying the current further may include independently applying a current to each of the plurality of sub-anodes.

Further embodiments of the present disclosure provide a horizontal electroplating apparatus. The a horizontal electroplating apparatus includes: a plating bath configured to hold a plating solution and configured to hold a substrate including a plurality of plating regions; a plurality of first cathodes and a plurality of second cathodes disposed on opposing sides of the plating bath and configured to apply different current densities to respective ones of the plurality of plating regions; and an anode overlying the plurality of first cathodes and the plurality of second cathodes, the anode configured to move between the plurality of first cathodes and the plurality of second cathodes.

In one embodiment of the horizontal electroplating apparatus, the plurality of first cathodes is configured to contact a first side of the substrate and the plurality of second cathodes is configured to contact a second side of the substrate.

In one embodiment of the horizontal electroplating apparatus, the anode comprises a matrix of sub-anodes.

In one embodiment of the horizontal electroplating apparatus, the plurality of first cathodes are configured to receive a first current and plurality of second cathodes are configured to receive a second current, and wherein a sum of the first and second currents is a constant.

It will be apparent to those skilled in the art that various modifications and variations may be made in the present disclosure without departing from the technical idea or scope of the disclosure. Thus, it may be intended that embodiments of the present disclosure cover the modifications and variations of the disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An electroplating apparatus, comprising:

a plating bath;

a substrate in a horizontal direction;

a plurality of cathodes on first and second sides of the substrate in a first direction on one surface of the substrate;

an anode above the substrate, the anode being spaced apart from the substrate and configured to be movable in the first direction; and a controller sensing a position of the anode, the controller configured to control a power supply circuit to regulate a voltage to be applied to the plurality of cathodes based on an area of plating on the substrate corresponding to the position of the anode, wherein the power supply circuit is regulated to apply a direct current voltage to the anode, an alternating current voltage to the plurality of cathodes, and a same voltage to a first cathode and a second cathode disposed facing each other among the plurality of cathodes, wherein a sum of the current flowing between the anode and the first cathode and the second cathode disposed facing each other among the plurality of cathodes is constant, wherein the anode includes a plurality of sub-anodes disposed in a matrix on a plane, and an insulating layer disposed between the plurality of sub-anodes has a mesh form, and wherein, in operation, the plurality of sub-anodes are separately applied with respective voltages to obtain a profile having a current density in a central portion of the anode that is uniform.

2. The electroplating apparatus of claim 1, wherein the plurality of cathodes includes:

a plurality of first cathodes on the first side of the substrate;

a plurality of second cathodes on a the second side of the substrate, the second side opposing the first side; and each of the plurality of first cathodes is configured to correspond to each of the plurality of second cathodes.

3. The electroplating apparatus of claim 2, wherein the power supply circuit is electrically connected to the plurality of cathodes and the anode to apply a current.

4. The electroplating apparatus of claim 1, wherein a length of the anode in the first direction is shorter than a length of the anode in a second direction perpendicular to the first direction on the surface of the substrate.

5. The electroplating apparatus of claim 4, wherein the plurality of sub-anodes are spaced apart from each other.

6. The electroplating apparatus of claim 1, further comprising a stage in the horizontal direction in the plating bath and configured to support the substrate.

7. A horizontal electroplating apparatus, comprising:

a plating bath having a space configured to be filled with a plating solution;

a plurality of first cathodes and a plurality of second cathodes disposed to face each other in the plating bath and configured to apply different current densities to respective plating regions;

an anode overlying the plurality of first cathodes and the plurality of second cathodes, the anode being configured to be movable between the plurality of first cathodes and the plurality of second cathodes; and a controller sensing a position of the anode, the controller configured to control a power supply circuit to regulate a voltage to be applied to the plurality of first cathodes and the plurality of second cathodes based on the plating region on the substrate corresponding to the position of the anode, wherein the power supply circuit is regulated to apply a direct current voltage to the anode, an alternating current voltage to the plurality of first cathodes and the plurality of second cathodes, and a same voltage to a first cathode and a second cathode disposed facing each other among the plurality of first cathodes and the plurality of second cathodes, wherein a sum of the current flowing between the anode and the first cathode and the second cathode disposed facing each other among the plurality of first cathodes and the plurality of second cathodes is constant, wherein the anode includes a plurality of sub-anodes disposed in a matrix on a plane, and an insulating layer disposed between the plurality of sub-anodes has a mesh form, and wherein, in operation, the plurality of sub-anodes are separately applied with respective voltages to obtain a profile having a current density in a central portion of the anode that is uniform.

8. The horizontal electroplating apparatus of claim 7, wherein when the space of the plating bath is filled with the plating solution, a virtual plane in which the plurality of first cathodes and the plurality of second cathodes are disposed being parallel to a surface of the plating solution.

9. The horizontal electroplating apparatus of claim 7, further comprising:

a substrate including a seed pattern in contact with the plurality of first cathodes and the plurality of second cathodes, the substrate being in the plating bath, and when the plating bath is filled with the plating solution, a surface of the plating solution is parallel to a surface of the substrate.

10. The horizontal electroplating apparatus of claim 7, wherein the power supply circuit is electrically connected to the plurality of first cathodes, the plurality of second cathodes, and the anode to apply a current.

11. The horizontal electroplating apparatus of claim 7, wherein the plurality of sub-anodes are spaced apart from each other.

12. A horizontal electroplating apparatus, comprising:

a plating bath configured to hold a plating solution and configured to hold a substrate including a plurality of plating regions;

a plurality of first cathodes and a plurality of second cathodes disposed on opposing sides of the plating bath and configured to apply different current densities to respective ones of the plurality of plating regions;

an anode overlying the plurality of first cathodes and the plurality of second cathodes, the anode configured to move between the plurality of first cathodes and the plurality of second cathodes; and a controller sensing a position of the anode, the controller configured to control a power supply circuit to regulate a voltage to be applied to the plurality of first cathodes and the plurality of second cathodes based on the plating region on the substrate corresponding to the position of the anode, wherein the power supply circuit is regulated to apply a direct current voltage to the anode, an alternating current voltage to the plurality of first cathodes and the plurality of second cathodes, and a same voltage to a first cathode and a second cathode disposed facing each other among the plurality of first cathodes and the plurality of second cathodes, wherein a sum of the current flowing between the anode and the first cathode and the second cathode disposed facing each other among the plurality of first cathodes and the plurality of second cathodes is constant, wherein the anode includes a plurality of sub-anodes disposed in a matrix on a plane, and an insulating layer disposed between the plurality of sub-anodes has a mesh form, and wherein, in operation, the plurality of sub-anodes are separately applied with respective voltages to obtain a profile having a current density in a central portion of the anode that is uniform.

13. The horizontal electroplating apparatus of claim 12, wherein the plurality of first cathodes are configured to contact a first side of the substrate and the plurality of second cathodes are configured to contact a second side of the substrate.

14. The horizontal electroplating apparatus of claim 12, wherein the plurality of first cathodes are configured to receive a first current and plurality of second cathodes are configured to receive a second current, and wherein a sum of the first and second currents is a constant.

* * * * *